US007784892B2

(12) United States Patent
Igarashi

(10) Patent No.: US 7,784,892 B2
(45) Date of Patent: Aug. 31, 2010

(54) PRINTER AND METHOD OF CONTROLLING THE SAME

(75) Inventor: Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 869 days.

(21) Appl. No.: 11/698,045

(22) Filed: Jan. 26, 2007

(65) Prior Publication Data

US 2007/0201929 A1 Aug. 30, 2007

(30) Foreign Application Priority Data

Jan. 26, 2006 (JP) ..... 2006-017377

(51) Int. Cl.
*B41J 29/38* (2006.01)

(52) U.S. Cl. ..... 347/16

(58) Field of Classification Search ..... 347/5, 347/16; 341/173

See application file for complete search history.

(56) References Cited

U.S. PATENT DOCUMENTS 4,789,874 A * 12/1988 Majette et al. ..... 347/37
2005/0275677 A1* 12/2005 Spicer ..... 347/19

FOREIGN PATENT DOCUMENTS

JP 2001-232882 A 8/2001

* cited by examiner

*Primary Examiner*—Julian D Huffman
*Assistant Examiner*—Jason S Uhlenhake
(74) *Attorney, Agent, or Firm*—Sughrue Mion, PLLC

(57) ABSTRACT

A scale is provided with a plurality of marks or slits arranged in a first direction such that a distance between centers of adjacent marks or slits in the first direction assumes a first length. An encoder is opposing the scale and includes: a photo emitter, operable to emit light; and a plurality of photo detectors, each of which has a light receiving region adapted to receive the light emitted from the photo emitter and transmitted by way of the marks or slits, and is operable to output a detection signal in accordance with a quantity of the light received by the light receiving region, so that the detection signal has a first cycle corresponding to the first length. A control signal generator is operable to generate a control signal having a second cycle which is ($1/2^{n1}$) of the first cycle. A controller is operable to estimate a rotation speed of a motor based on a third cycle which is defined by subsequent ($2^{n1}$) second cycles. Here, n1 is an integer no less than one.

9 Claims, 13 Drawing Sheets

S1
S3
T1
S5
S2
S4
T1
S6
T(AH)
T2(AH1)
T2(AH2)
S7
E(A2)
E(A1)
E(A2)
E(A1)
T2(AL1)
T2(AL2)
T(AL)
T(CH)
T2(CH1)
T2(CH2)
S9
E(C2)
E(C1)
T2(CL1)
T2(CL2)
T(CL)
T(BH)
T2(BH1)
T2(BH2)
S8
E(B2)
E(B1)
T2(BL1)
T2(BL2)
T(BL)
T(DH)
T2(DH1)
T2(DH2)
S10
E(D2)
E(D1)
T2(DL1)
T2(DL2)
T(DL)

FIG. 13
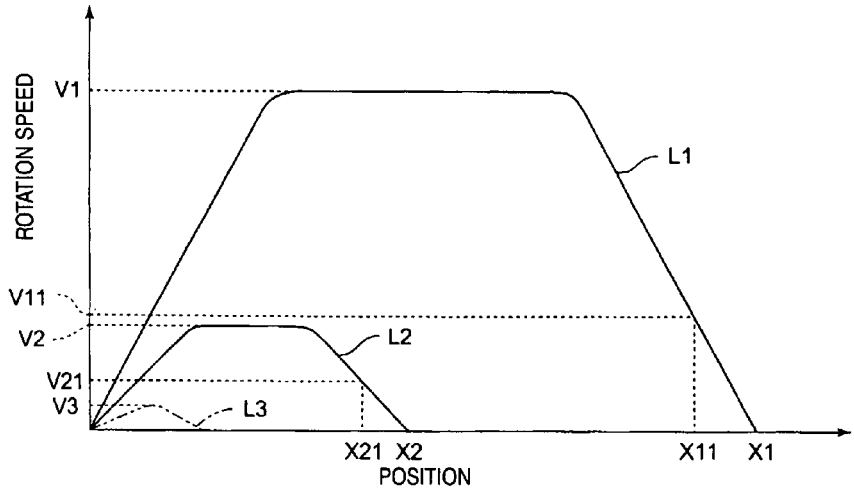
FIG. 14A
FIG. 14B
FIG. 14C
FIG. 14D
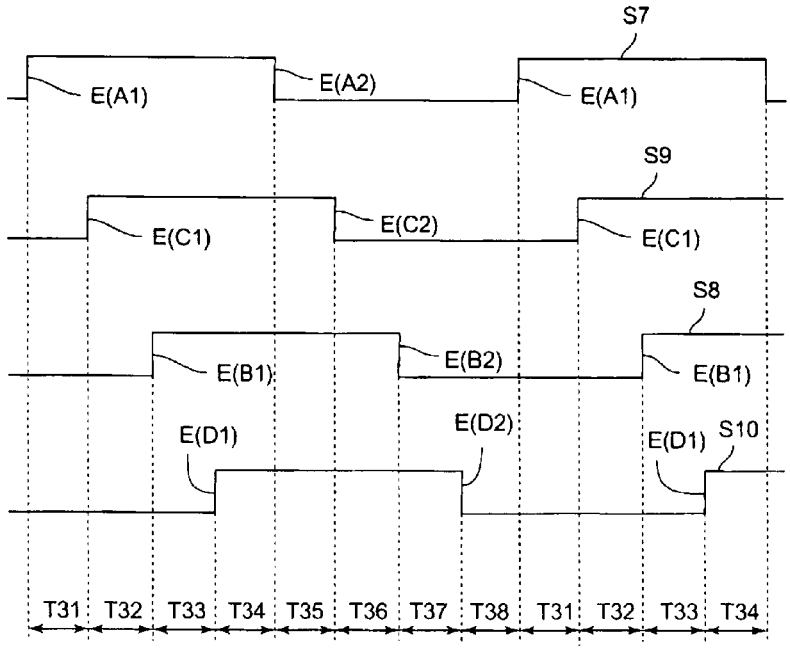

S1
S3
T1
S5
S2
S4
T1
S6
T2
T2
S7
T2
T2
S9
T2
T2
S8
T2
T2
S10
T3(FH1)
T(FH)
T3(FH2)
T3(FH3)
T3(FH4)
E(F2)
E(F1)
S11
T3(FL1)
T3(FL2)
T3(FL3)
T3(FL4)
T(FL)
T3(GH1)
T(GH)
T3(GH2)
T3(GH3)
T3(GH4)
S12
E(G2)
E(G1)
T3(GL1)
T3(GL2)
T3(GL3)
T3(GL4)
T(GL)

PRINTER AND METHOD OF CONTROLLING THE SAME

BACKGROUND

1. Field of the Invention

The present invention relates to a printer and a method of controlling the same.

2. Related Art

Various kinds of motors, such as a sheet conveying motor for driving a conveying roller that conveys a printing sheet and a carriage motor for driving a carriage mounting a printing head, are provided in a printer. As these motors, DC motors are widely used because the DC motors generate little noises. A printer provided with a DC motor has an encoder including a scale, which has marks or slits arranged at prescribed distances therebetween in order to control position, speed, and the like of the DC motor, and a detector that detects the marks or slits of the scale and outputs a prescribed signal.

For example, in order to control a sheet conveying motor, a printer includes a disc-shaped scale, which has a plurality of slits arranged at prescribed distances therebetween, and a detector configured to include light emitting elements and light receiving elements with the slits interposed therebetween. This kind of scale rotates together with a conveying roller. In addition, this kind of detector generally outputs two rectangular-wave control signals whose phases are shifted from each other by 90° on the basis of detection signals output from the light receiving elements. The control signals are input to a prescribed controller that controls the printer. The controller controls a motor and the like on the basis of the two control signals. Such a technique is disclosed in Japanese Patent Publication No. 2001-232882A (JP-A-2001-232882), for example.

In recent years, in order to improve the printing quality, a motor or the like mounted in a printer is required to be controlled with high precision. In order to perform the high-precision control, it is necessary to output a signal with high resolution from an encoder. As a method of outputting a signal with high resolution from an encoder, two known methods may be considered. That is, one method is to enlarge the diameter of a disc-shaped scale while maintaining a distance between slits and the other method is to narrow the distance between slits while maintaining the diameter of the disc-shaped scale.

However, in the case of enlarging the diameter of a scale, such a scale is difficult to be disposed in a printer that is required to be downsized. Furthermore, in order to prepare a space for disposing the scale, the mechanical configuration of the printer becomes complicated. On the other hand, in the case of narrowing the distance between slits, it becomes difficult to manufacture the scale itself.

SUMMARY

It is therefore one advantageous aspect of the invention to provide a printer and a method of controlling the same, capable of performing high resolution control with simple and appropriate structure.

According to one aspect of the invention, there is provided a printer, comprising:

a scale provided with a plurality of marks or slits arranged in a first direction such that a distance between centers of adjacent marks or slits in the first direction assumes a first length;

an encoder, opposing the scale and comprising:

a photo emitter, operable to emit light; and a plurality of photo detectors, each of which has a light receiving region adapted to receive the light emitted from the photo emitter and transmitted by way of the marks or slits, and is operable to output a detection signal in accordance with a quantity of the light received by the light receiving region, so that the detection signal has a first cycle corresponding to the first length;

a control signal generator, operable to generate a control signal having a second cycle which is $(1/2^{n1})$ of the first cycle;

a motor; and a controller, operable to estimate a rotation speed of the motor based on a third cycle which is defined by subsequent $(2^{n1})$ second cycles, wherein n1 is an integer no less than one.

The photo detectors may be arranged in a second direction perpendicular to the first direction while being shifted in the first direction by a second length which is not an integral multiple of the first length.

The second length may be $(n2+1/8)$ times of the first length. Here, n1 is one, and n2 is an integer no less than zero.

The second length may be $(n2+1/16)$ times of the first length. Here, n1 is one, and n2 is an integer no less than zero.

The motor may be operable to transport a medium adapted to be subjected to printing.

The printer may further comprise a carriage, operable to carry a printing head which is operable to eject ink toward a target medium. The motor may be operable to move the carriage.

The controller may be operable to estimate a rotary position of the motor. The controller may be operable to estimate the rotation speed of the motor based on the third cycle at least one of when the estimated rotation speed is no less than a prescribed speed and when a difference between the estimated rotary position and a target position is no less than a prescribed value. The controller may be operable to estimate the rotation speed of the motor based on the second cycle at least one of when the estimated rotation speed is less than the prescribed speed and when a difference between the estimated rotary position and a target position is less than the prescribed value.

The controller may be operable to estimate a rotary position of the motor. The controller may be operable to estimate the rotation speed of the motor based on the third cycle at least one of when the estimated rotation speed is greater than a prescribed speed and when a difference between the estimated rotary position and a target position is greater than a prescribed value. The controller may be operable to estimate the rotation speed of the motor based on the second cycle at least one of when the estimated rotation speed is no greater than the prescribed speed and when a difference between the estimated rotary position and a target position is no greater than the prescribed value.

The controller may be operable to estimate the rotation speed of the motor based on a time interval corresponding to the second length when the estimated rotation speed is no greater than a prescribed speed.

According to one aspect of the invention, there is provided a method executed in a printer which comprises: a motor; a scale provided with a plurality of marks or slits arranged in a first direction such that a distance between centers of adjacent marks or slits in the first direction assumes a first length; and an encoder, opposing the scale and comprising: a photo emitter, operable to emit light; and a plurality of photo detectors, each of which has a light receiving region adapted to receive the light emitted from the photo emitter and transmitted by way of the marks or slits, and is operable to output a detection signal in accordance with a quantity of the light received by the light receiving region, so that the detection signal has a first cycle corresponding to the first length. The method comprises:

generating a control signal having a second cycle which is ($1/2^{n1}$) of the first cycle; and estimating a rotation speed of the motor based on a third cycle which is defined by subsequent ($2^{n1}$) second cycles, wherein n1 is an integer no less than one.

BRIEF DESCRIPTION OF THE DRAWINGS

FIG. 13 is a graph showing an example of a target speed curve of the sheet conveying motor of FIG. 1.

FIGS. 14A to 14D are enlarged views showing parts of control signals shown in FIGS. 10E to 10H.

DETAILED DESCRIPTION OF THE EXEMPLARY EMBODIMENTS

Exemplary embodiments of the invention will be described below in detail with reference to the accompanying drawings.

Figure 1:
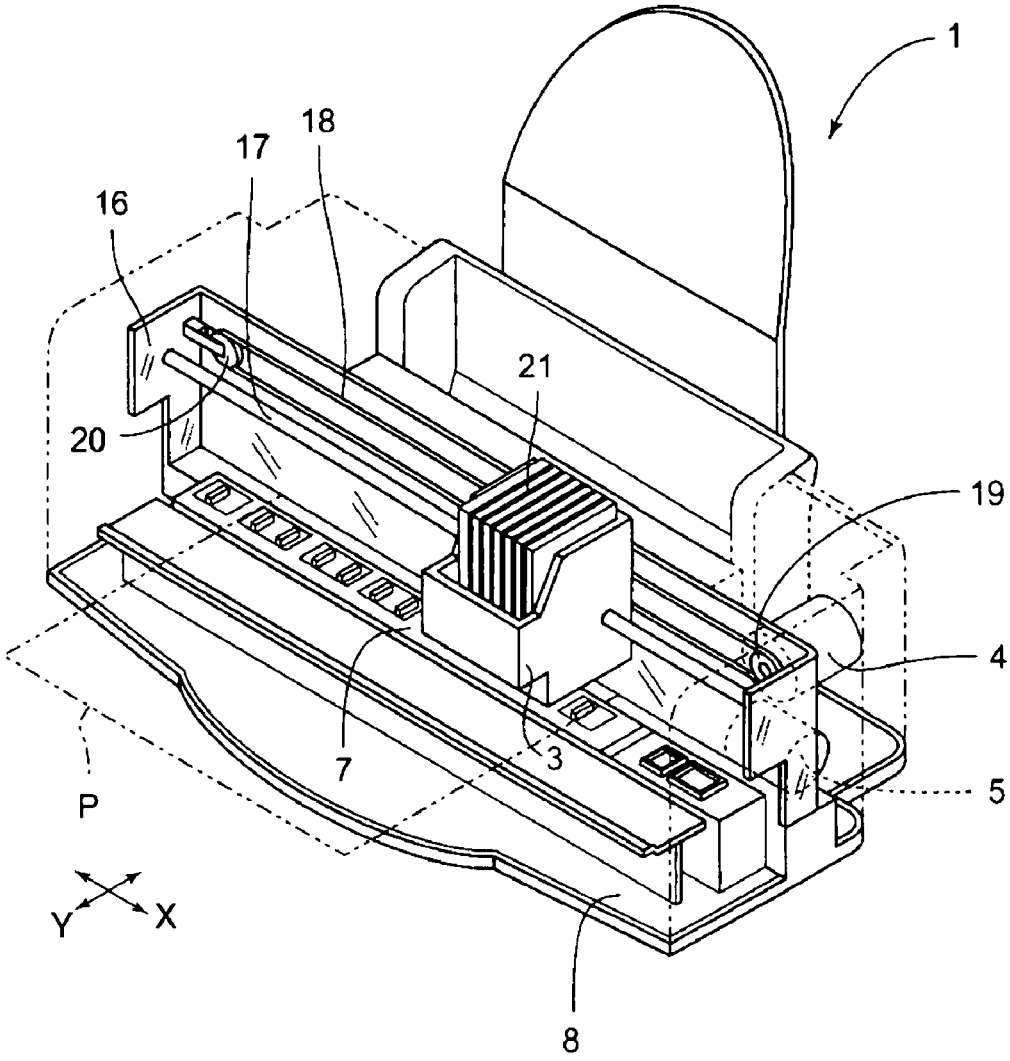
FIG. 1 is a perspective view showing an internal configuration of a printer according to one embodiment of the invention.
Figure 2:
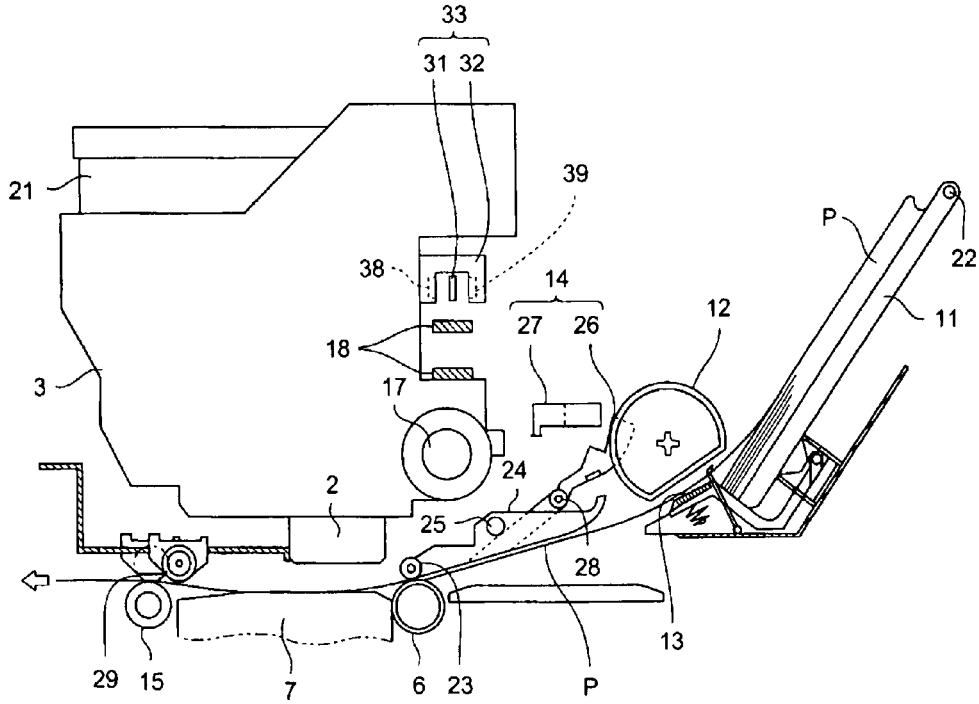
FIG. 2 is a side view showing a configuration related to a sheet conveying operation of the printer of FIG. 1.
Figure 3:
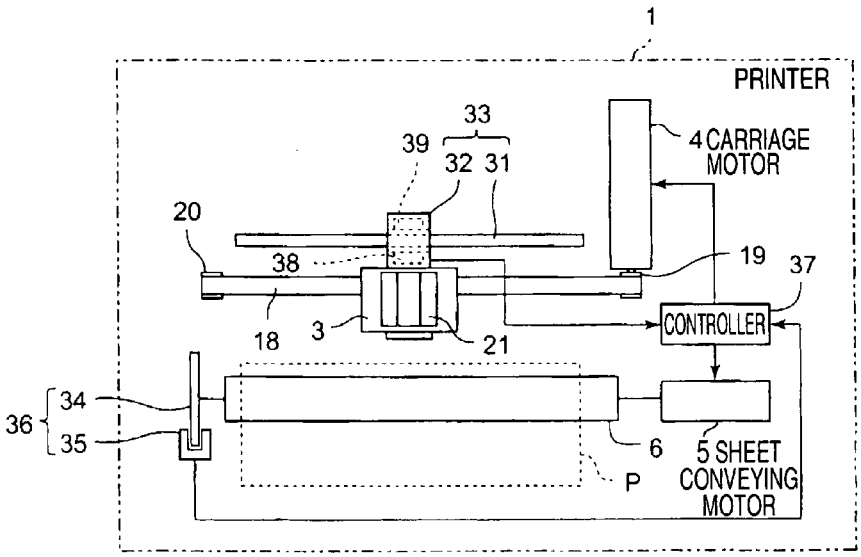
FIG. 3 is a block diagram showing a mechanism for detecting an operation of a motor in the printer of FIG. 1.

A printer 1 according to one embodiment of the invention is an ink jet printer that performs printing by ejecting ink onto, for example, a printing sheet P used as an object to be printed. As shown in FIGS. 1 to 3, the printer 1 includes: a carriage 3 provided with a printing head 2 that ejects ink droplets; a carriage motor 4 that drives the carriage 3 in the primary scanning direction X; a sheet conveying motor 5 that conveys the printing sheet P in the secondary scanning direction Y; a sheet conveying roller 6 connected to the sheet conveying motor 5; a platen 7 disposed so as to oppose a nozzle formation face (lower face in FIG. 2) of the printing head 2; and a body chassis 8 on which the constituent parts described above are mounted. In the present embodiment, both the carriage motor 4 and the sheet conveying motor 5 are direct-current (DC) motors.

Further, as shown in FIG. 2, the printer 1 includes: a hopper 11 on which a printing sheet P to be subjected to printing is placed; a sheet feeding roller 12 and a separating pad 13 that guide the printing sheet P placed on the hopper 11 to the inside of the printer 1; a sheet detector 14 that detects passage of the printing sheet P guided from the hopper 11 to the inside of the printer 1; and a sheet ejecting roller 15 that ejects the printing sheet P from the inside of the printer 1.

The carriage 3 can move in the primary scanning direction X along a guide shaft 17 supported by a support frame 16 fixed to the body chassis 8 and a timing belt 18. That is, the timing belt 18 is disposed to have constant tension under a state in which a part of the timing belt 18 is fixed to the carriage 3 (refer to FIG. 2) and is stretched between a pulley 19 fixed to an output shaft of the carriage motor 4 and a pulley 20 rotatably fixed to the support frame 16. The guide shaft 17 slidably holds the carriage 3 so that the carriage 3 is guided in the primary scanning direction X. Moreover, in addition to the printing head 2, an ink cartridge 21 in which various kinds of ink supplied to the printing head 2 is stored is mounted on the carriage 3.

The sheet feeding roller 12 is coupled with the sheet conveying motor 5 through a gear (not shown), such that the sheet feeding roller 12 is driven by the sheet conveying motor 5. As shown in FIG. 2, the hopper 11 is a plate-shaped member on which the printing sheet P can be placed. In addition, the hopper 11 is pivotable about a pivot shaft 22 provided in an upper portion of the hopper 11 by a cam mechanism (not shown). In addition, a lower end of the hopper 11 is elastically pressed against the sheet feeding roller 12 or separated from the sheet feeding roller 12 by the pivot motion caused by the cam mechanism. The separating pad 13 is formed of a member with a high friction coefficient and is disposed at the position facing the sheet feeding roller 12. Moreover, when the sheet feeding roller 12 rotates, a surface of the sheet feeding roller 12 is pressed against the separating pad 13. Accordingly, when the sheet feeding roller 12 rotates, an uppermost one of the printing sheets P placed on the hopper 11 passes through a portion, at which the surface of the sheet feeding roller 12 is pressed against the separating pad 13, and is then carried toward the sheet ejection side. At this time, the other printing sheets P that are placed on the hopper 11 subsequent to the uppermost printing sheet P are prevented from being carried to the sheet ejection side.

The sheet conveying roller 6 is coupled with the sheet conveying motor 5 directly or through a gear (not shown) provided therebetween. In addition, as shown in FIG. 2, a conveying follower roller 23 that conveys the printing sheet P together with the sheet conveying roller 6 is provided in the printer 1. The conveying follower roller 23 is rotatably held at a sheet ejection side of a follower roller holder 24 that is configured to be pivotable about a pivot shaft 25. The follower roller holder 24 is biased counterclockwise in the drawing by a spring (not shown), such that the conveying follower roller 23 receives a biasing force directed toward the sheet conveying roller 6 all the time. In addition, when the sheet conveying roller 6 is driven, the conveying follower roller 23 also rotates together with the sheet conveying roller 6.

The sheet detector 14 is configured to include a detection lever 26 and a sensor 27 and is provided near the follower roller holder 24, as shown in FIG. 2. The detection lever 26 can pivot about a pivot shaft 28. In addition, when the printing sheet P that is in a state shown in FIG. 2 completely passes through a bottom of the detection lever 26, the detection lever 26 rotates counterclockwise. If the detection lever 26 rotates, light emitted from a light emitting element of the sensor 27 and directed toward a light receiving element of the sensor 27 is blocked, and thus passing of the printing sheet P can be detected.

The sheet ejecting roller 15 is disposed at the sheet ejection side of the printer 1 and is coupled with the sheet conveying motor 5 through a gear (not shown) provided therebetween. In addition, as shown in FIG. 2, an ejecting follower roller 29 that ejects the printing sheet P together with the sheet ejecting roller 15 is provided in the printer 1. In the same manner as the conveying follower roller 23, the ejecting follower roller 29 also receives, due to a spring (not shown), a biasing force directed toward the sheet ejecting roller 15 all the time. Furthermore, when the sheet ejecting roller 15 is driven, the ejecting follower roller 29 also rotates together with the sheet ejecting roller 15.

Furthermore, as shown in FIGS. 2 and 3, the printer 1 includes: a linear encoder 33 having a linear scale 31 and a detector 32 for detecting the rotary position (that is, position of the carriage 3 in the primary scanning direction X) of the carriage motor 4, the rotation speed (that is, speed of the carriage 3) of the carriage motor 4, and the like; and a rotary encoder 36 having a rotary scale 34 and a detector 35 for detecting the rotary position (that is, position of the printing sheet P in the secondary scanning direction Y) of the sheet conveying motor 5 in the secondary scanning direction Y, the rotation speed (that is, speed at which the printing sheet P is carried) of the sheet conveying motor 5, and the like.

Figure 4:
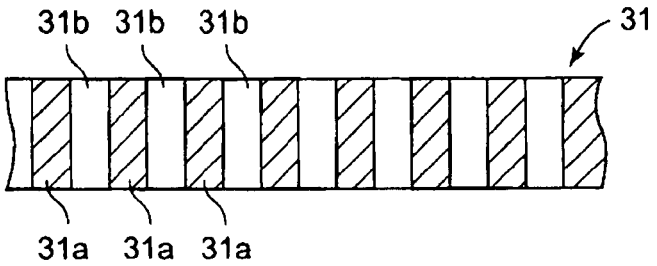
FIG. 4 is an enlarged front view showing a part of a linear scale shown in FIG. 2.

As shown in FIG. 2, the detector 32 of the linear encoder 33 is equipped with a light emitting element 38 and a light receiving element 39 and is fixed to the carriage 3. The linear scale 31 is formed of a thin plate, such as a transparent resin, to have a long and thin shape and is fixed to the support frame 16 in parallel with the primary scanning direction X. As shown in FIG. 4, a plurality of marks 31*a* are formed with prescribed distances therebetween in the primary scanning direction X. Specifically, black printing is performed on a surface of the linear scale 31 such that vertical stripes are formed while maintaining prescribed distances therebetween in the primary scanning direction X. The vertical stripes that are printed in black are the marks 31*a*. In the marks 31*a*, light emitted from the light emitting element 38 is blocked. In contrast, in a transparent portion 31*b* between the marks 31*a*, the light emitted from the light emitting element 38 is transmitted therethrough. In the linear encoder 33, the light receiving element 39 receives light that is emitted toward the linear scale 31 from the light emitting element 38 and is transmitted through the transparent portions 31*b*. In addition, as shown in FIG. 3, a signal that is output from the detector 32 on the basis of an amount of received light in the light receiving element 39 is input to a controller 37.

In addition, the linear scale 31 may be formed of a thin steel plate made of stainless steel or the like. Moreover, instead of the marks 31*a* described above, slits that penetrate the linear scale 31 may be formed in the linear scale 31. In this case, the light emitted from the light emitting element 38 is transmitted through the slits, but the light emitted from the light emitting element 38 is blocked in portions between the slits.

The rotary scale 34 is formed in the disc shape and is fixed to the sheet conveying roller 6, such that the rotary scale 34 rotates integrally together with sheet conveying roller 6. That is, if the sheet conveying roller 6 rotates once, the rotary scale 34 also rotates once. The detector 35 is fixed to the body chassis 8 through a bracket (not shown). A signal output from the detector 35 is input to the controller 37, as shown in FIG. 3. In addition, the rotary scale 34 may be coupled with the sheet conveying roller 6 through a gear provided therebetween, for example. However, by directly fixing the rotary scale 34 and the sheet conveying roller 6 to each other so that the rotary scale 34 and the sheet conveying roller 6 can rotate integrally, an amount of rotation of the rotary scale 34 can correspond to an amount of rotation of the sheet conveying roller 6 in a one-by-one manner without an error, such as backlash occurring in an engaged portion of the gear. Details of the configuration of the rotary encoder 36 will be described later.

Figure 6:
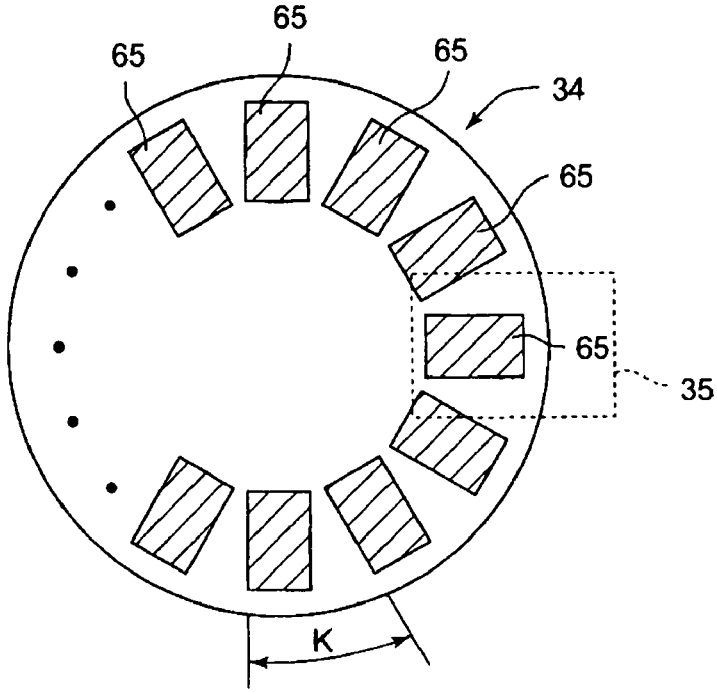
FIG. 6 is a front view of the rotary encoder of FIG. 3.

For example, the rotary scale 34 is formed in the disc shape by using a transparent thin plate made of plastic, as shown in FIG. 6. At a periphery of the rotary scale 34, a plurality of marks 65 are disposed with equal angle distances therebetween in the circumferential direction of the rotary scale 34. Specifically, black printing is performed along an outer periphery of a surface of the rotary scale 34 while maintaining an equal angle distance in the circumferential direction of the rotary scale 34. The portions that are printed in black serve as the marks 65. In the marks 65*a*, light emitted from a light emitting element 67, which will be described later, provided in the detector 35 is blocked. In contrast, in a transparent portion between the marks 65, the light emitted from the light emitting element 67 is transmitted therethrough. In addition, the rotary scale 34 may be formed of a thin steel plate made of stainless steel or the like. Moreover, instead of the marks 65 described above, slits that penetrate the rotary scale 34 may be formed in the rotary scale 34. In this case, the light emitted from the light emitting element 67 is transmitted through the slits, but the light emitted from the light emitting element 67 is blocked in portions between the slits. In the present embodiment, 1440 marks 65 are formed in the rotary scale 34 having a diameter of 60 mm, and the arrangement distance (pitch) K between the marks 65, which are located at the outer periphery part of the rotary scale 34, in the circumferential direction of the rotary scale 34 is about 0.131 mm. Moreover, the distance between two adjacent marks 65 in a portion detected by the detector 35 is approximately equal to the width of each of the marks 65 in the circumferential direction. In addition, in FIG. 6, the marks 65 are enlarged in the circumferential direction for the sake of convenience. However, in actuality, since 1440 marks 65 are formed around one circumference, the width of each of the marks 65 in the circumferential direction is extremely small.

As described above, the rotary scale 34 rotates integrally together with the sheet conveying roller 6. That is, if the sheet conveying roller 6 rotates once, the rotary scale 34 also rotates once. In this case, assuming that the peripheral length of the sheet conveying roller 6 is one inch, the resolution of only the rotary scale 34 is 180 dpi. In addition, under a state in which the rotary scale 34 is coupled with the sheet conveying roller 6 through a gear or the like as described above, the rotary scale 34 may be configured to rotate twice if the sheet conveying roller 6 rotates once.

Figure 7:
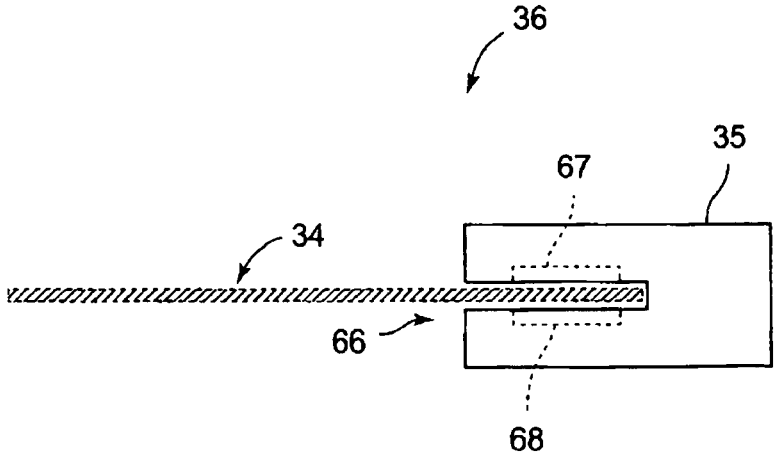
FIG. 7 is a side view of the rotary encoder of FIG. 3.

As shown in FIG. 7, the detector 35 has an approximately rectangular parallelepiped housing. In the detector 35, a recessed portion 66 is formed from a lateral side (left side of FIG. 7) of the housing to a central portion of the housing. The light emitting element 67 that is, for example, a light emitting diode is provided on one of two faces (two faces opposing each other in the vertical direction of FIG. 7) of the recessed portion 66, and a substrate 68 is provided on the other face. On the substrate 68, a plurality of light receiving elements 69 serving as a plurality of detection elements are formed (refer to FIG. 8). The position of the detector 35 is determined in consideration of the rotary scale 34 such that an outer periphery part of the rotary scale 34 is partially inserted in the recessed portion 66. Therefore, between the light emitting element 67 and the light receiving element 69, a part in which the outer periphery part of the rotary scale 34, that is, the marks 65 of the rotary scale 34 are formed is positioned.

Figure 8:
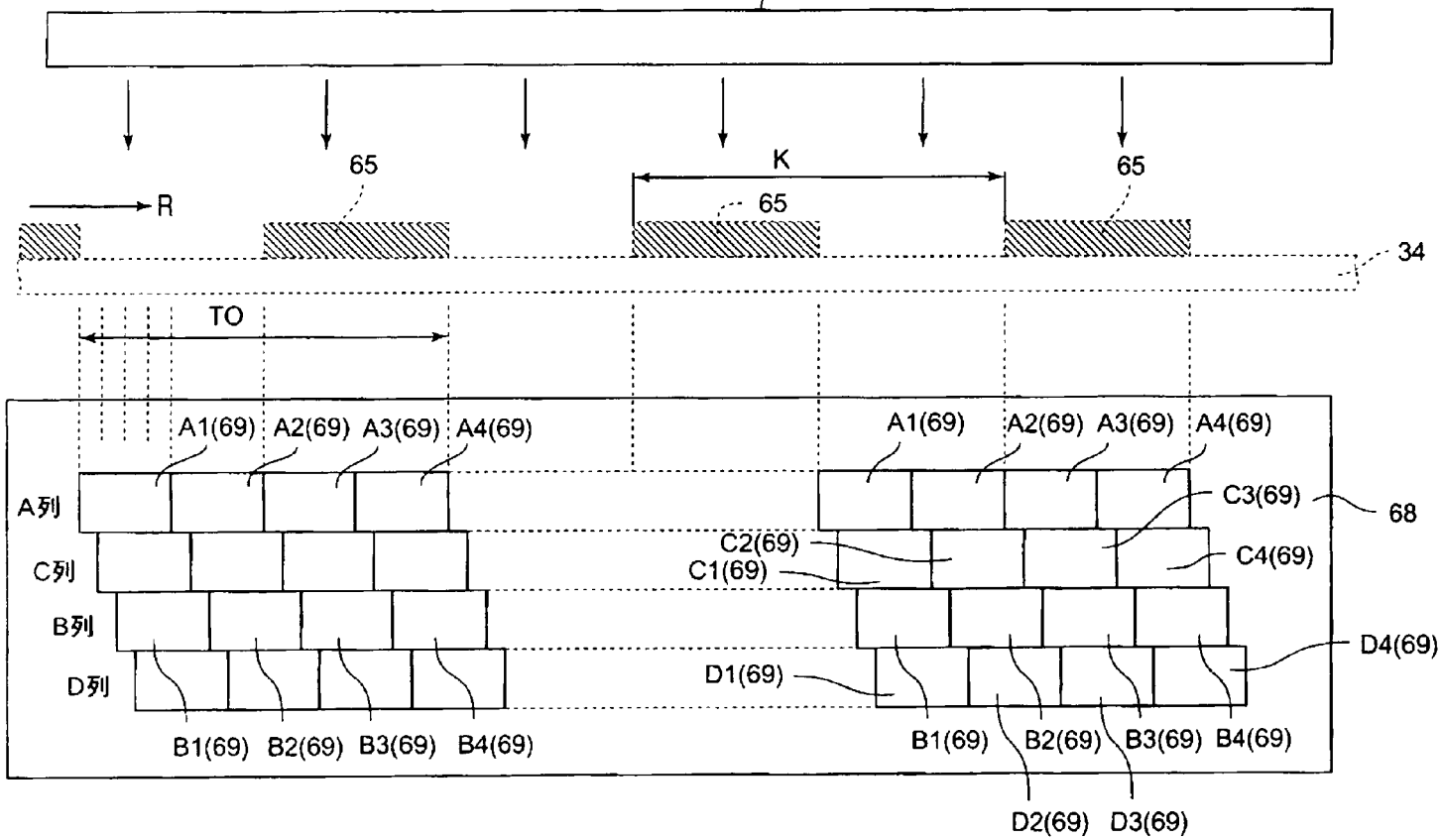
FIG. 8 is a schematic view showing light receiving elements in the rotary encoder of FIG. 3.

As shown in FIG. 8, a plurality of light receiving elements 69 are arranged on the substrate 68 in four rows along a rotational direction R of the rotary scale 34. Hereinafter, four rows of plural light receiving elements 69 that are arranged are called A-row, B-row, C-row, and D-row from an upper side of FIG. 8. For example, each of the light receiving elements 69 is a photodiode and outputs a signal having a level corresponding to an amount of received light. Furthermore, in FIG. 8, in a case where the sheet conveying motor 6 rotates in the positive direction (direction in which the printing sheet P is carried to the ejection side), that is, in a case where the rotary scale 34 rotates in the positive direction R, the rotary scale 34 moves from the left side to the right side in the drawing.

Furthermore, as shown in FIG. 8, assuming that light beams emitted from the light emitting element 67 are illuminated as parallel beams onto the substrate 68, bright parts and dark parts (shadows) are formed on the surface of the substrate 68 with the same cycle as the arrangement pitch K between the marks 65 located at the outer periphery part of the rotary scale 34. That is, light beams emitted from the light emitting element 67 are illuminated onto portions of the substrate 68 corresponding to the marks 65, and the light beams emitted from the light emitting element 67 are illuminated onto portions of the substrate 68 corresponding to portions between the marks 65 of the rotary scale 34. Therefore, a distance of one cycle of the bright parts and dark parts formed on the surface of the substrate 68 is constant and equal to the arrangement pitch K between the marks 65 formed on the rotary scale 34 (hereinafter, the distance of one cycle is denoted as a bright/dark cycle T0).

Furthermore, in a case where the light beams emitted from the light emitting element 67 cannot be considered as parallel beams, that is, in a case where the light beams emitted from the light emitting element 67 are diffused light beams, the bright/dark cycle T0 of the bright parts and dark parts formed on the substrate 68 changes in the lateral direction in FIG. 8. Specifically, the bright/dark cycle T0 is short in a part of the substrate 68 closest to the light emitting element 67 and is longer as being away from the light emitting element 67.

The plurality of light receiving elements 69 located in each of the A to D-rows are formed over a plurality of bright/dark cycles T0 (three periods in an example shown in FIG. 8) on the substrate 68. Further, FIG. 8 illustrates the arrangement relationship of the light receiving elements 69 in a case where light beams emitted from the light emitting element 67 are parallel beams. Each of the light receiving elements 69 has a light receiving surface having a size obtained by diving the bright/dark cycle T0 (that is, the arrangement pitch K between the marks 65) formed on the surface of the substrate 68 into four approximately equal parts. That is, each of the plurality of light receiving elements 69 located in each row has a size corresponding to a quarter of the arrangement pitch K. Moreover, as shown in FIG. 8, in each of the A to D-rows, a first light receiving element A1 (B1, C1, or D1), a second light receiving element A2 (B2, C2, or D2), a third light receiving element A3 (B3, C3, or D3), and fourth light receiving element A4 (B4, C4 or D4) are formed as a set corresponding to the arrangement pitch K (bright/dark cycle T0). A plurality of sets described above are arranged in each of the A to D-rows.

The light receiving elements 69 located in the four rows are shifted a little in the rotational direction R of the rotary scale 34, respectively. Specifically, the light receiving elements 69 located in the four rows are shifted from each other by 1/16 of the arrangement pitch K in the rotational direction R of the rotary scale 34, respectively. In the present embodiment, the light receiving elements 69 located in the B-row are formed to be shifted by 1/8 of the arrangement pitch K to the right side of the light receiving elements 69 located in the A-row in FIG. 8. The light receiving elements 69 located in the C-row are formed to be shifted by 1/16 of the arrangement pitch K to the right side of the light receiving elements 69 located in the A-row in FIG. 8. The light receiving elements 69 located in the D-row are formed to be shifted by 3/16 of the arrangement pitch K to the right side of the light receiving elements 69 located in the A-row in FIG. 8. That is, the light receiving elements 69 located in the D-row are formed to be shifted by 1/8 of the arrangement pitch K to the right side of the light receiving elements 69 located in the C-row in FIG. 8.

That is, referring to FIG. 8, the light receiving element A1 located at a left end of the A-row, the light receiving element C1 located at a left end of the C-row, the light receiving element B1 located at a left end of the B-row, and the light receiving element D1 located at a left end of the D-row are arranged in this order to be shifted from each other by 1/16 of the arrangement pitch K. Moreover, in the present embodiment, a plurality of light receiving elements A1 to A4 located in the A-row form a first detection element, and a plurality of light receiving elements B1 to B4 located in the B-row form a second detection element. In addition, a plurality of light receiving elements C1 to C4 located in the C-row form a third detection element, and a plurality of light receiving elements D1 to D4 located in the D-row form a fourth detection element.

Further, when the rotary scale 34 rotates together with the sheet conveying roller 6, the marks 65 move between the light emitting element 67 of the detector 35 and the plurality of light receiving elements 69. As the marks 65 move, the light receiving elements 69 outputs a signal having a level corresponding to the amount of received light. That is, the light receiving elements 69 corresponding to the marks 65 output high-level signals, and the other light receiving elements 69 corresponding to portions between the marks 65 output low-level signals. Thus, each of the light receiving elements 69 outputs a signal that changes with a period corresponding to the movement speed of the marks 65.

Figure 9:
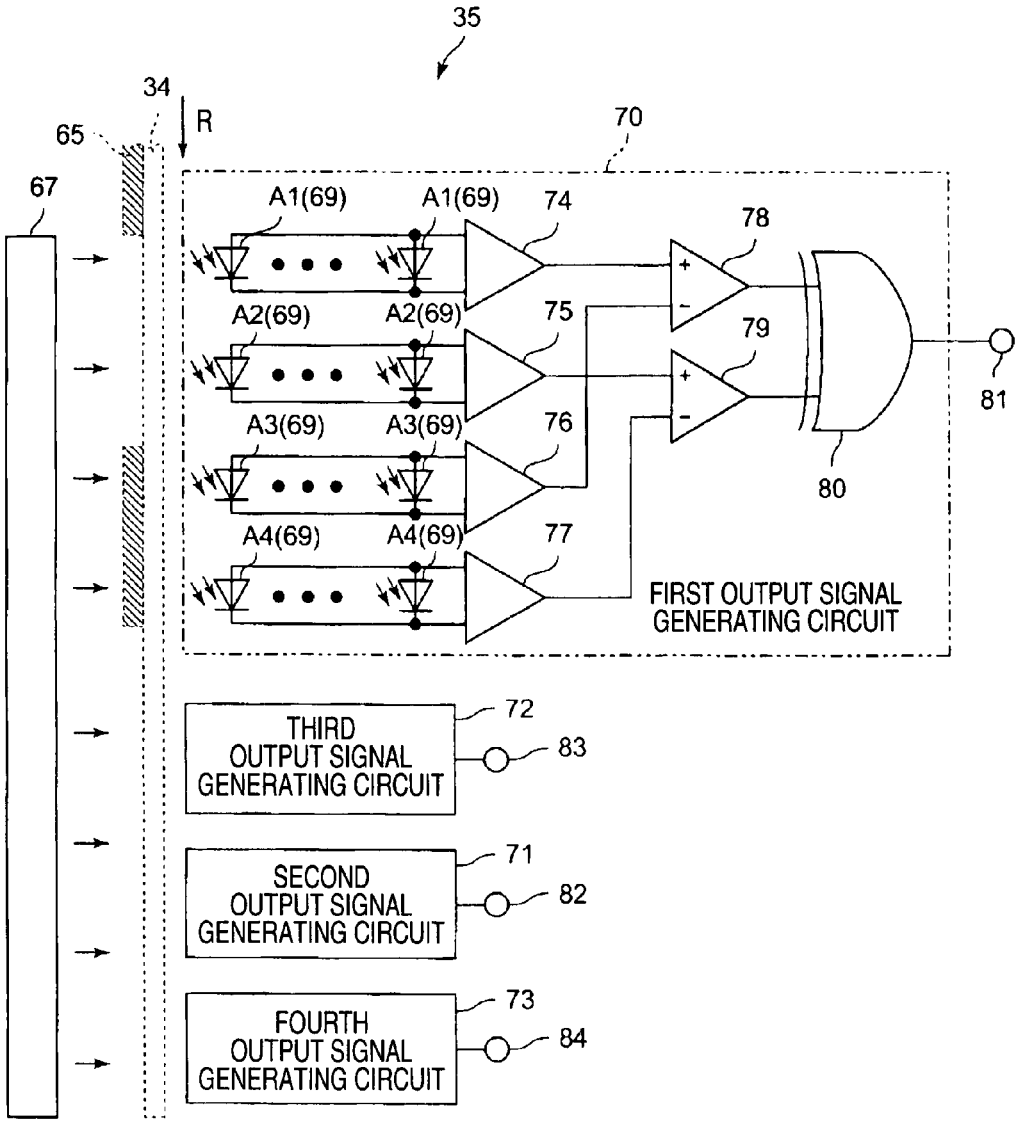
FIG. 9 is a circuit diagram of the rotary encoder of FIG. 3.

As shown in FIG. 9, the detector 35 provided with the rotary encoder 36 includes a first output signal generating circuit 70 having the plurality of light receiving elements 69 located in the A-row, a second output signal generating circuit 71 having the plurality of light receiving elements 69 located in the B-row, a third output signal generating circuit 72 having the plurality of light receiving elements 69 located at the row, and a fourth output signal generating circuit 73 having the plurality of light receiving elements 69 located in the D-row.

The first output signal generating circuit 70 includes: the plurality of light receiving elements 69 located in the A-row; four amplifiers of first to fourth amplifiers 74, 75, 76, and 77; a first differential signal generating circuit 78; a second differential signal generating circuit 79; and an exclusive-OR circuit 80.

As shown in FIG. 8, four light receiving elements 69 of the first light receiving element A1, the second light receiving element A2, the third light receiving element A3, and the fourth light receiving element A4 are formed as a set corresponding to the arrangement pitch K. A plurality of sets described above are arranged in the A-row. In addition, the plurality of first light receiving elements A1 located in the A-row are connected in parallel with the first amplifier 74. Each of the first light receiving elements A1 located in the A-row outputs a signal having a level corresponding to each amount of received light. The first amplifier 74 outputs a detection signal S1 obtained by amplifying the signals output from the first light receiving elements A1 located in the A-row.

Similarly, the plurality of second light receiving elements A2 located in the A-row are connected in parallel with the second amplifier 75. The second amplifier 75 outputs a detection signal S2 obtained by amplifying the signals output from the plurality of second light receiving elements A2 located in the A-row. In addition, the plurality of third light receiving elements A3 located in the A-row are connected in parallel with the third amplifier 76. The third amplifier 76 outputs a detection signal S3 obtained by amplifying the signals output from the plurality of third light receiving elements A3 located in the A-row. In addition, the plurality of fourth light receiving elements A4 located in the A-row are connected in parallel with the fourth amplifier 77. The fourth amplifier 77 outputs a detection signal S4 obtained by amplifying the signals output from the plurality of fourth light receiving elements A4 located in the A-row.

Figures 10A, 10B, 10C, 10D, 10E, 10F, 10G, 10H:
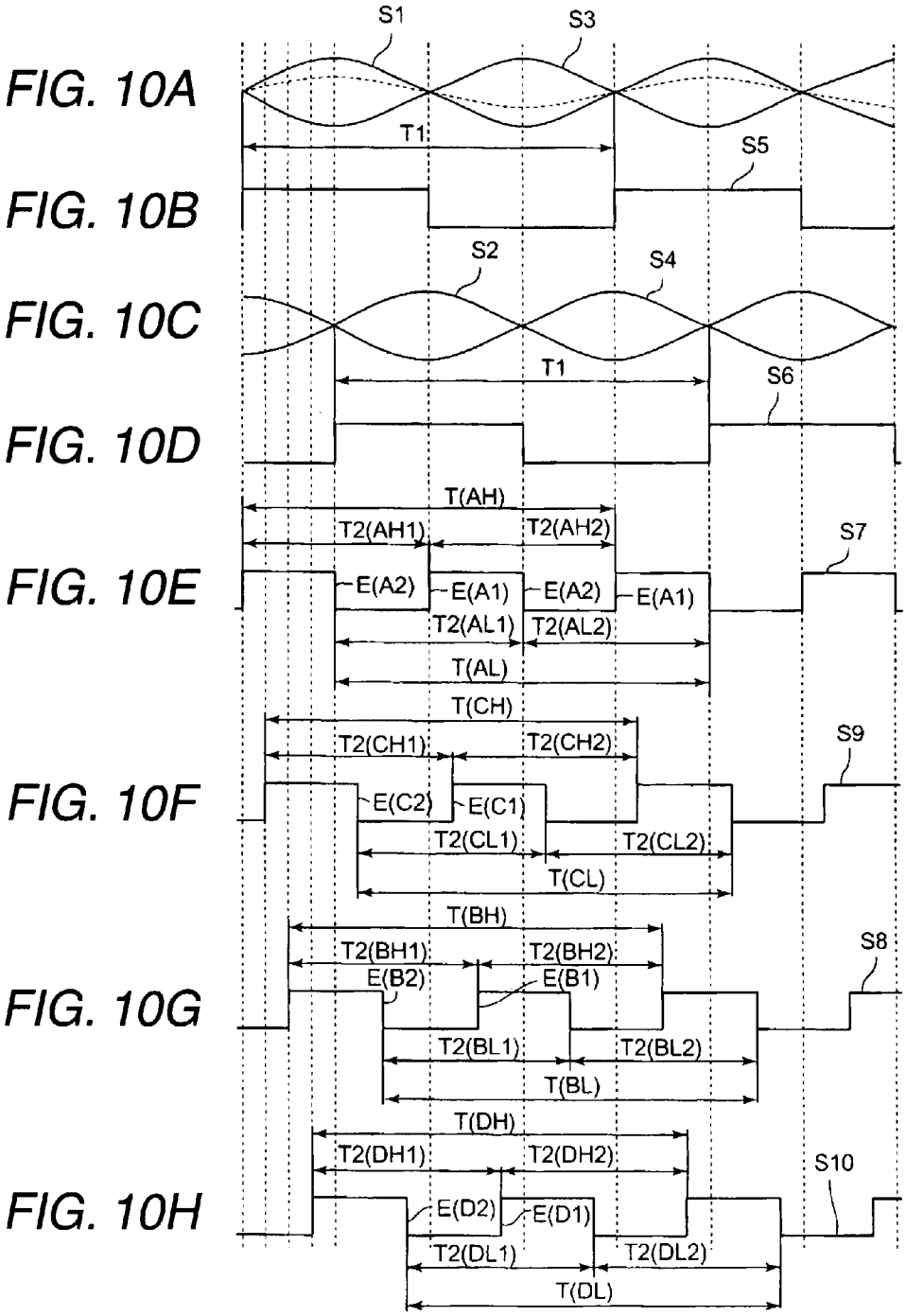
FIGS. 10A to 10H are waveform charts showing signals generated in the rotary encoder of FIG. 3.

As shown in FIG. 8, the first light receiving element A1 and the third light receiving element A3 are formed on the substrate 68 so as to be shifted from each other by a half of the arrangement pitch K. Accordingly, as shown in FIG. 10A, a phase of the detection signal S1 output from the first amplifier 74 and a phase of the detection signal S3 output from the third amplifier 76 are shifted from each other by 180°. Similarly, the second light receiving element A2 and the fourth light receiving element A4 are formed on the substrate 68 so as to be shifted from each other by a half of the arrangement pitch K. Accordingly, as shown in FIG. 10C, a phase of the detection signal S2 output from the second amplifier 75 and a phase of the detection signal S4 output from the fourth amplifier 77 are shifted from each other by 180°. In addition, in a case where the rotary scale 34 rotates at a constant speed, cycles T1 of the detection signals S1 to S4 output from the amplifier 74, 75, 76, and 77 are equal.

The first amplifier 74 and the third amplifier 76 output the detection signals S1 and S3 to the first differential signal generating circuit 78. The detection signal S1 output from the first amplifier 74 is input to a non-inverting input terminal of the first differential signal generating circuit 78, and the detection signal S3 output from the third amplifier 76 is input to an inverting input terminal of the first differential signal generating circuit 78.

The first differential signal generating circuit 78 outputs a high-level signal if a level of the detection signal S1 input to the non-inverting input terminal is higher than a level of the detection signal S3 input to the inverting input terminal and outputs a low-level signal if the level of the detection signal S1 input to the non-inverting input terminal is lower than the level of the detection signal S3 input to the inverting input terminal. Thus, the first differential signal generating circuit 78 outputs a digital signal S5. That is, as shown in FIG. 10B, the first differential signal generating circuit 78 outputs the digital signal S5, which has a duty of about 50% and is approximately rectangular and has the cycle T1 approximately equal to that of the detection signals S1 and S3 output from the first light receiving element A1 and the third light receiving element A3.

Similarly, the detection signal S2 output from the second amplifier 75 is input to a non-inverting input terminal of the second differential signal generating circuit 79, and the detection signal S4 output from the fourth amplifier 77 is input to an inverting input terminal of the second differential signal generating circuit 79. In addition, the second differential signal generating circuit 79 outputs a high-level signal if a level of the detection signal S2 input to the non-inverting input terminal is higher than a level of the detection signal S4 input to the inverting input terminal and outputs a low-level signal if the level of the detection signal S2 input to the non-inverting input terminal is lower than the level of the detection signal S4 input to the inverting input terminal. That is, as shown in FIG. 10D, the second differential signal generating circuit 79 outputs a digital signal S6, which has a duty of about 50% and is approximately rectangular and has the cycle T1 approximately equal to that of the detection signals S2 and S4 output from the second light receiving element A2 and the fourth light receiving element A4.

As shown in FIG. 8, the first light receiving element A1 and the second light receiving element A2 are formed to be shifted from each other by a quarter of the arrangement pitch K. Accordingly, a phase of the digital signal S5 shown in FIG. 10B and a phase of the digital signal S6 shown in FIG. 10D are shifted from each other by 90°.

The digital signal S5 output from the first differential signal generating circuit 78 and the digital signal S6 output from the second differential signal generating circuit 79 are input to the exclusive-OR circuit 80. Both the exclusive-OR circuit 80 outputs a low-level signal when both of the two input signals are high-level signals or low-level signals and outputs a high-level signal when only one of the two input signals is a high-level signal. That is, the exclusive-OR circuit 80 outputs a first control signal S7 that is approximately rectangular and changes with a cycle T2 (period corresponding to a half of the cycle T1 of each of the digital signals S5 and S6) corresponding to a half of the cycle T1 of each of the detection signals S1 to S4, as shown in FIG. 10E. The first control signal S7 is output from an output terminal 81 of the detector 35.

Moreover, referring to FIG. 10E, it is assumed that periods, each of which is a period between rising edges E(A1) of the first control signal S7 and which are adjacent to each other, are T2(AH1) and T2(AH2) for the sake of convenience. In addition, it is assumed that periods, each of which is a period between falling edges E(A2) of the first control signal S7 and which are adjacent to each other, are T2(AL1) and T2(AL2) for the sake of convenience.

Since the internal configurations of the second output signal generating circuit 71, the third output signal generating circuit 72, and the fourth output signal generating circuit 73 are the same as that of the first output signal generating circuit 70, the configurations are not shown and an explanation thereof is omitted. In addition, as shown in FIGS. 10G, 10F, and 10H, the second output signal generating circuit 71, the third output signal generating circuit 72, and the fourth output signal generating circuit 73 output second control signal S8, third control signal S9, and fourth control signal S10 that change with the cycle T2 corresponding to a half of the cycle T1 of each of the detection signals S1 to S4, respectively.

Further, referring to FIG. 10G, it is assumed that periods, each of which is a period between rising edges E(B1) of the second control signal S8 and which are adjacent to each other, are T2(BH1) and T2(BH2) for the sake of convenience. In addition, it is assumed that periods, each of which is a period between falling edges E(B2) of the second control signal S8 and which are adjacent to each other, are T2(BL1) and T2(BL2) for the sake of convenience. Similarly, referring to FIG. 10F, it is assumed that periods, each of which is a period between rising edges E(C1) of the third control signal S9 and which are adjacent to each other, are T2(CH1) and T2(CH2) for the sake of convenience. In addition, it is assumed that periods, each of which is a period between falling edges E(C2) of the third control signal S8 and which are adjacent to each other, are T2(CL1) and T2(CL2) for the sake of convenience. Similarly, referring to FIG. 10H, it is assumed that periods, each of which is a period between rising edges E(D1) of the fourth control signal S10 and which are adjacent to each other, are T2(DH1) and T2(DH2) for the sake of convenience. In addition, it is assumed that periods, each of which is a period between falling edges E(D2) of the fourth control signal S10 and which are adjacent to each other, are T2(DL1) and T2(DL2) for the sake of convenience.

As mentioned above, the light receiving elements 69 located in the B-row are shifted by ⅛ of the arrangement pitch K to the right side of the light receiving elements 69 located in the A-row in FIG. 8. The light receiving elements 69 located in the C-row are shifted by 1/16 of the arrangement pitch K to the right side of the light receiving elements 69 located in the A-row in FIG. 8. The light receiving elements 69 located in the D-row are shifted by 3/16 of the arrangement pitch K to the right side of the light receiving elements 69 located in the A-row in FIG. 8. Accordingly, as shown in FIGS. 10E to 10H, a phase of the second control signal S8 is shifted by 90° with respect to a phase of the first control signal S7. A phase of the third control signal S9 is shifted by 45° with respect to the phase of the first control signal S7. A phase of the fourth control signal S10 is shifted by 90° with respect to the phase of the third control signal S9 and by 135° with respect to the phase of the first control signal S7.

Figure 5:
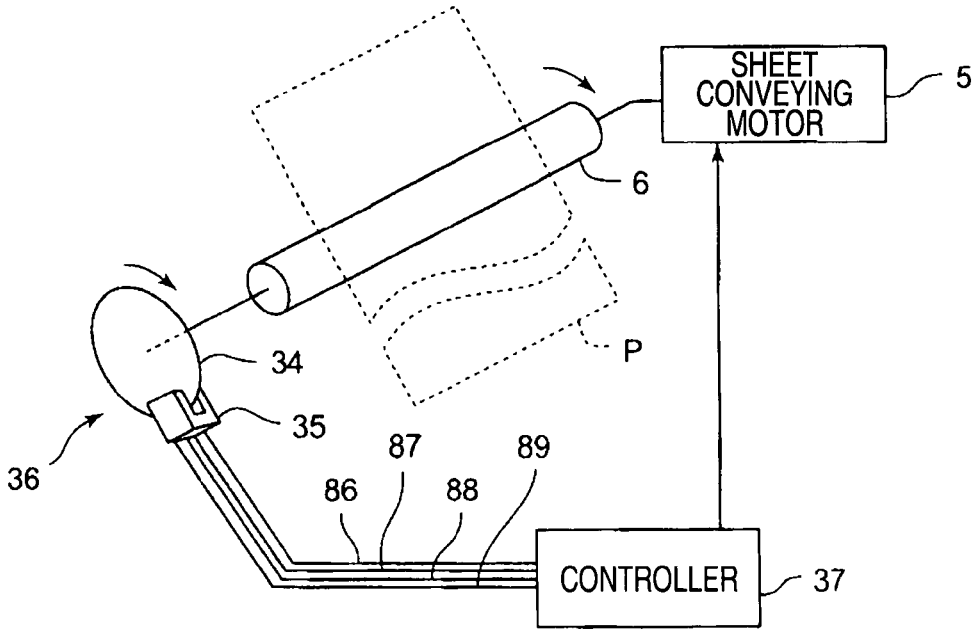
FIG. 5 is a block diagram showing a configuration related to a rotary encoder shown in FIG. 3.

Moreover, as shown in FIG. 9, the second control signal S8 is output from an output terminal 82 of the detector 35, the third control signal S9 is output from an output terminal 83 of the detector 35, and the fourth control signal S10 is output from an output terminal 84 of the detector 35. That is, the detector 35 has four output terminals 81 to 84 and outputs the four first to fourth control signals S7 to S10 from the four output terminals 81, 82, 83, and 84, respectively. The four output terminals 81, 82, 83, and 84 are connected to the controller 37 through four signal lines 86, 87, 88, and 89, respectively, as shown in FIG. 5.

Figure 11:
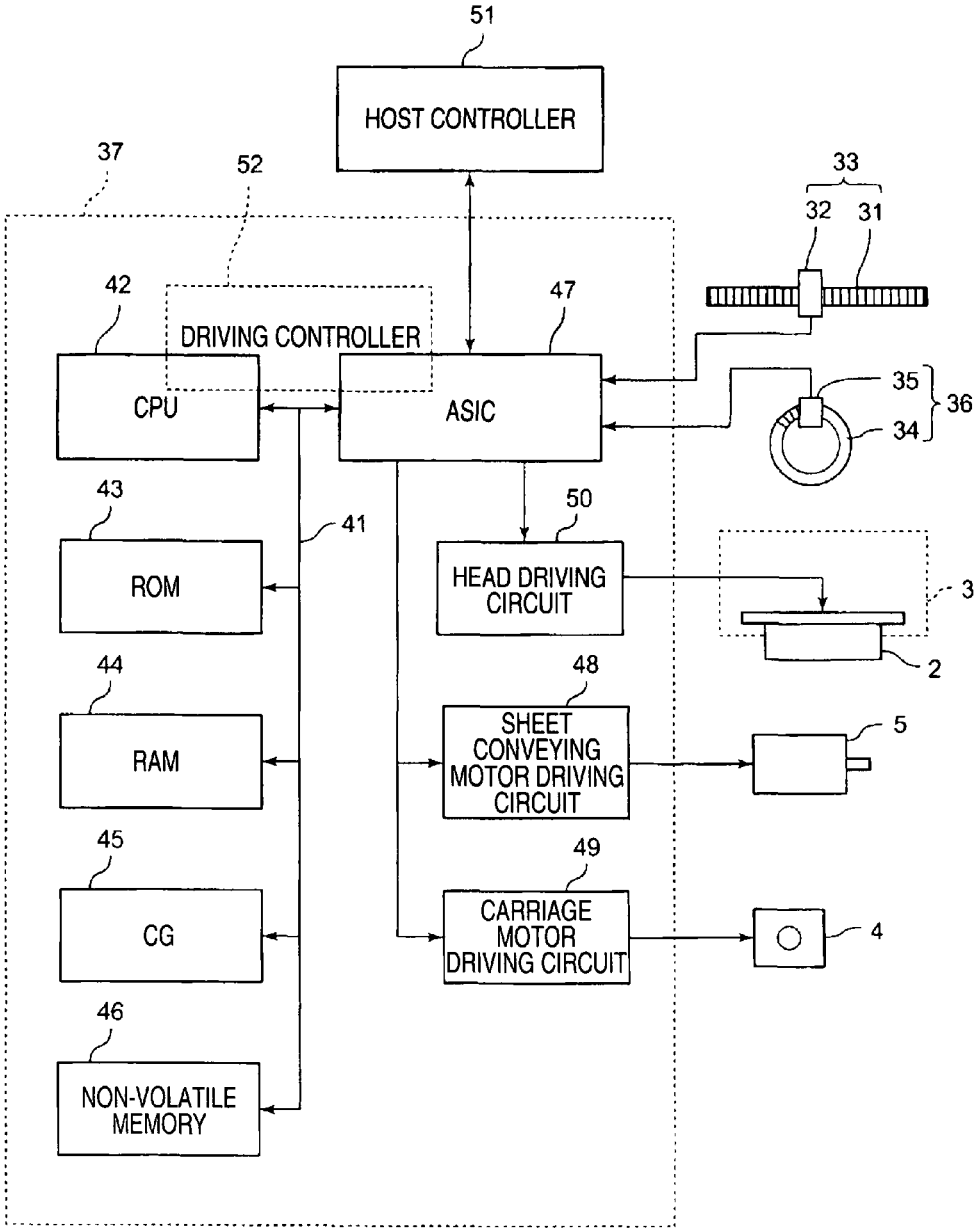
FIG. 11 is a block diagram showing a configuration related to a controller shown in FIG. 3.

As shown in FIG. 11, the controller 37 includes a bus 41, a CPU 42, a ROM 43, a RAM 44, a character generator (CG) 45, a non-volatile memory 46, an ASIC 47, a sheet conveying motor driving circuit 48, a carriage motor driving circuit 49, a head driving circuit 50, and the like.

The CPU 42 performs operation processing for executing a control program of the printer 1 stored in the ROM 43 and the non-volatile memory 46 and other necessary operation processing. In addition, the ROM 43 is stored with a control program for controlling the printer 1, data required for processing, and the like. For example, a target speed table which is used by PID control, which will be described later, and in which a target rotation speed corresponding to each rotary position of the sheet conveying motor 5 is set is stored in the ROM 43. In addition, for example, a minute rotation speed which is used by BS control, which will be described later, and which corresponds to an amount of minute rotation of the sheet conveying motor 5 is stored in the ROM 43.

The RAM 44 is temporarily stored with a program being executed by the CPU 42, data being operated by the CPU 42, and the like. In addition, a dot pattern corresponding to a print signal input to the ASIC 47 is loaded to the CG 45 and is then stored therein. Various kinds of data, which needs to be stored even after the printer 1 is powered off, are stored in the non-volatile memory 46.

As shown in FIG. 11, signals from the linear encoder 33 and the rotary encoder 36 are input to the ASIC 47. For example, as shown in FIG. 5, the controller 37 and the rotary encoder 36 are coupled with each other through the four signal lines 86, 87, 88, and 89 and the four first to fourth control signals S7 to S10 are input to the ASIC 47. In addition, the ASIC 47 supplies signals, which are used to control various kinds of motors such as the carriage motor 4 and the sheet conveying motor 5, to the sheet conveying motor driving circuit 48 and the carriage motor driving circuit 49 and supplies a signal, which is used to control the printing head 2, to the head driving circuit 50. The ASIC 47 has an interface circuit built therein, such that the print signal supplied from a host controller 51 can be input to the ASIC 47.

The speed control or the like of the carriage motor 4 and the sheet conveying motor 5 is performed by cooperation of the CPU 42 and the ASIC 47. That is, a part of the CPU 42 and a part of the ASIC 47 constitute a driving controller 52 serving as a control circuit for performing the speed control or the like of the carriage motor 4 and the sheet conveying motor 5 that are DC motors. More specifically, in the driving controller 52, the part of the CPU 42 performs various operations for performing the speed control or the like of the carriage motor 4 and the sheet conveying motor 5 on the basis of various kinds of signals that are input from the linear encoder 33 or the rotary encoder 36 through the ASIC 47. Furthermore, in the driving controller 52, the part of the ASIC 47 receives a signal from the linear encoder 33 or the rotary encoder 36 or outputs a signal to the sheet conveying motor driving circuit 48 and the carriage motor driving circuit 49 on the basis of an operation result of the CPU 42.

The sheet conveying motor driving circuit 48 performs driving control on the sheet conveying motor 5 by the use of a signal (specifically, signal from the ASIC 47) from the driving controller 52. In the present embodiment, for example, PWM (pulse width modulation) control is adopt as a method of controlling the sheet conveying motor 5. In this case, the sheet conveying motor driving circuit 48 outputs a PWM driving signal. Similarly, the carriage motor driving circuit 49 also performs driving control on the carriage motor 4 by the use of the signal from the driving controller 52.

The head driving circuit 50 drives nozzles (not shown) of the printing head 2 on the basis of a control command transmitted from the ASIC 47.

The bus 41 is a signal line by which the above-described constituent components of the controller 37 are connected to one another. That is, the bus 41 allows the CPU 42, the ROM 43, the RAM 44, the CG45, the non-volatile memory 46, and the ASIC 47 to be connected to one another, such that data can be transmitted therebetween.

As mentioned above, the driving controller 52 serves as a control circuit for performing the speed control or the like of the carriage motor 4 and the sheet conveying motor 5. The configuration of a speed controller 53, which controls the speed of the sheet conveying motor 5, in the driving controller 52 will now be described.

In the printer 1 according to the present embodiment, the PID control is generally adopted as a method of controlling the sheet conveying motor 5 when carrying the printing sheet P. In the PID control, proportional control, integral control, and differential control are combined such that the current rotation speed of the sheet conveying motor 5 approaches to the target rotation speed. As described above, the ROM 43 is stored with a plurality of target speed tables in which target rotation speeds corresponding to rotary positions of the sheet conveying motor 5 are set. A target speed curve created on the basis of the target speed table is schematically shown as a solid line in FIG. 13, for example. That is, a target speed curve L1 is a curve having an acceleration region, a constant speed region, and a deceleration region in this order toward a target stopping position X1. In the case of the target speed curve L1, a final rotation speed (that is, rotation speed in the constant speed region) of the sheet conveying motor 5 at the time of carrying the printing sheet P is a speed V1, for example.

Further, the rotation speed and the target stopping position of the sheet conveying motor 5 in the constant speed region may be changed according to a print mode or the like. For example, there also exists a target speed curve L2 that has an acceleration region, a constant speed region, and a deceleration area in this order toward a target stopping position X2 closer than the target stopping position X1. In the case of the target speed curve L2, the rotation speed in the constant speed region is, for example, a speed V2 slower than the speed V1.

On the other hand, in the printer 1, in order to convey leading and trailing ends of the printing sheet P with high precision for the purpose of positioning of the printing sheet P, the printing sheet P may be slightly conveyed at an extremely low speed (that is, the final rotation speed of the sheet conveying motor 5 at the time of conveying the printing sheet P may be low, and the sheet conveying motor 5 may rotate at a very low speed by a minute amount. Specifically, in the present embodiment, the printing sheet P is conveyed by upstream conveying rollers (sheet conveying roller 6 and conveying follower roller 23) and downstream conveying rollers (sheet ejecting roller 15 and ejecting follower roller 29). However, the printing sheet is conveyed by only the upstream rollers in a region near a leading end of a printing sheet, the printing sheet is conveyed by the upstream rollers and the downstream rollers in the middle region of the printing sheet, and the printing sheet is conveyed by only the downstream rollers in a region near a trailing end of the printing sheet. In this case, when the leading end of the printing sheet goes into between the sheet ejecting roller 15 and the ejecting follower roller 29, which are downstream conveying rollers, and the trailing end of the printing sheet escapes from between the sheet conveying roller 6 and the conveying follower roller 23, which are upstream conveying rollers, an error in conveying the printing sheet easily occurs. Especially when a lower end of the printing sheet escapes from between the upstream rollers, a force that causes the printing sheet to flick by in the direction in which the printing sheet is conveyed occurs at the moment the printing sheet escapes from the conveying follower roller 23, which makes large an error in conveying the printing sheet. This phenomenon is remarkable when the conveying follower roller 23 is formed of made of an elastic material.

Therefore, the printing sheet P is slightly conveyed at a very low speed when the leading end of the printing sheet P goes into between the downstream conveying rollers (sheet ejecting roller 15 and ejecting follower roller 29) and the trailing end of the printing sheet P escapes from between the upstream conveying rollers (sheet conveying roller 6 and conveying follower roller 23). In this case, in order to control the sheet conveying motor 5 by using the PID control, the amount of rotation of the sheet conveying motor 5 is extremely small. Accordingly, instead of the PID control, another control method is adopted as a method of controlling the sheet conveying motor 5. Hereinafter, a control method when slightly conveying the printing sheet P at the very low speed is denoted as "BS control". Details of the BS control will be described later. In addition, in a case where the load fluctuation at the time of conveying the printing sheet P is very large, the sheet conveying motor 5 may be controlled by the BS control.

Further, unlike the PID control, in the BS control, the target speed table in which the target rotation speed corresponding to each rotary position of the sheet conveying motor 5 is set is not necessarily used. For this reason, in the case of the BS control, target speed curves, such as the target speed curves L1 and L2 shown in FIG. 13 cannot be created. However, in the case of the BS control, the rotation speed of the sheet conveying motor 5 changes like a dashed chain line L3 that is shown as an image in FIG. 13. In the speed-changing curve L3, the final rotation speed of the sheet conveying motor 5 at the time of conveying the printing sheet P is a speed V3, for example. Moreover, the ratio of the speed V1 in the target speed curve L1, the speed V2 in the target speed curve L2, and the speed V3 of the speed-changing curve L3 is as follows. That is, assuming that the speed V2 is "1", the speed V1 is "20" and the speed V3 is "0.1".

Figure 12:
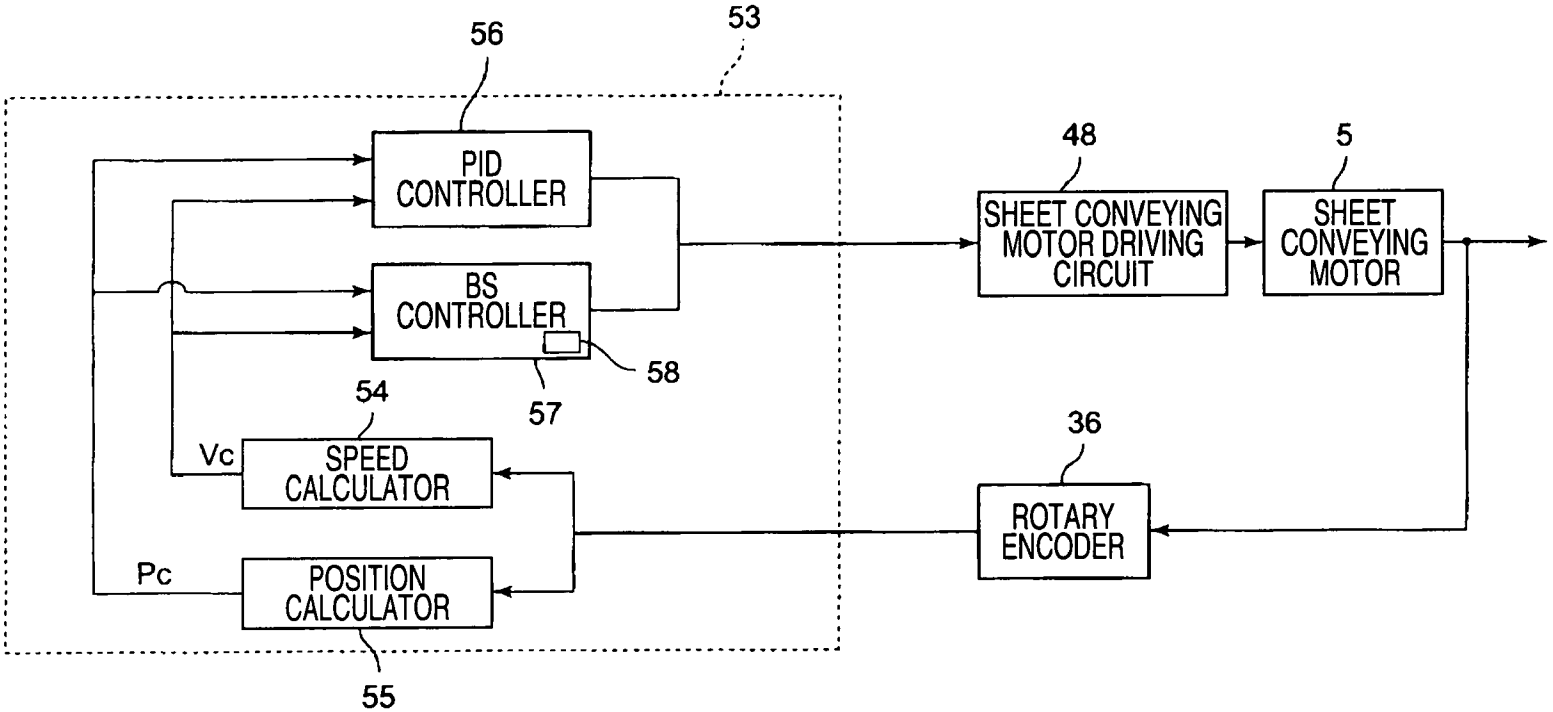
FIG. 12 is a block diagram showing a configuration of a speed controller for a sheet conveying motor in a drive control unit shown in FIG. 11.

Thus, in the present embodiment, the two control methods of the PID control and the BS control are adopted as methods of controlling the sheet conveying motor 5. Accordingly, the speed controller 53 includes a speed calculator 54, a position calculator 55, a PID controller 56, and a BS controller 57, as shown in FIG. 12. Furthermore, even though a speed controller, which is used to control the speed of the carriage motor 4, of the driving controller 52 has the configuration equivalent to each of the speed calculator 54, the position calculator 55, and the PID controller 56, the speed controller does not have the configuration equivalent to the BS controller 57.

The first to fourth control signals S7 to S10 output from the rotary encoder 36 are input to the speed calculator 54. The speed calculator 54 calculates a current rotation speed of the sheet conveying motor 5 on the basis of the four control signals S7 to S10 and outputs a current rotation speed signal (that is, current conveying speed signal of the printing sheet P) Vc corresponding to the present rotation speed. In the speed calculator 54, a method of calculating the current rotation speed in a case where the sheet conveying motor 5 is controlled by the PID control is different from that in a case where the sheet conveying motor 5 is controlled by the BS control. Moreover, even in a case where the sheet conveying motor 5 is controlled by the PID control, the method of calculating the current rotation speed changes according to the rotation speed of the sheet conveying motor 5. Hereinafter, the method of calculating the current rotation speed in the speed calculator 54 will be described.

First, the method of calculating the current rotation speed in a case where the sheet conveying motor 5 is controlled by the PID control will be described. In a case where the sheet conveying motor 5 rotates at a speed equal to or higher than a prescribed rotation speed while the sheet conveying motor 5 is accelerating, is rotating at a constant speed, and is decelerating (for example, in FIG. 13, when the rotation speed is equal to or larger than a speed V11 in a case where the sheet conveying motor 5 is controlled by the PID control on the basis of the target speed curve L1 or when the rotation speed is equal to or larger than a speed V21 in a case where the sheet conveying motor 5 is controlled by the PID control on the basis of the target speed curve L2), the current rotation speed is calculated by using a sum of two adjacent cycles of the four control signals S7 to S10.

Specifically, as shown in FIGS. 10E to 10H, the speed calculator 54 calculates the current rotation speed by using a cycle T(AH) that is a sum of a cycle T2(AH1) and a cycle T2(AH2), a cycle T(AL) that is a sum of a cycle T2(AL1) and a cycle T2(AL2), a cycle T(CH) that is a sum of a cycle T2(CH1) and a cycle T2(CH2), a cycle T(CL) that is a sum of a cycle T2(CL1) and a cycle T2(CL2), a cycle T(BH) that is a sum of a cycle T2(BH1) and a cycle T2(BH2), a cycle T(BL) that is a sum of a cycle T2(BL1) and a cycle T2(BL2), a cycle T(DH) that is a sum of a cycle T2(DH1) and a cycle T2(DH2), or a cycle T(DL) that is a sum of a cycle T2(DL1) and a cycle T2(DL2). That is, in the order of the cycles T(AH), T(CH), T(BH), T(DH), T(AL), T(CL), T(BL), T(DL), T(AH), . . . , the current rotation speed is sequentially calculated on the basis of the periods and the speed calculator 54 sequentially outputs a current rotation speed signal Vc corresponding to the calculated current rotation speed. In addition, the current rotation speed of the sheet conveying motor 5 may be calculated by using a sum of two adjacent cycles of one or two control signals arbitrarily selected from the four control signals S7 to S10.

Further, in the case that the sheet conveying motor 5 is controlled by the PID control, when the sheet conveying motor 5 rotates at a speed lower than a prescribed rotation speed while the sheet conveying motor 5 is decelerating (for example, in FIG. 13, when the rotation speed is lower than the speed V11 or the speed V21), the current rotation speed is calculated by using periods of the four control signals S7 to S10.

Specifically, as shown in FIGS. 10E to 10H, in the order of the cycles T2(AH1), T2(CH1), T2(BH1), T2(DH1), T2(AL1), T2(CL1), T2(BL1), T2(DL1), T2(AH2), T2(CH2), T2(BH2), T2(DH2), T2(AL2), T2(CL2), T2(BL2), T2(DL2), T2(AH1), . . . , the current rotation speed is sequentially calculated on the basis of the periods and the speed calculator 54 sequentially outputs the current rotation speed signal Vc corresponding to the calculated current rotation speed.

Furthermore, in the above description, when the sheet conveying motor 5 rotates at a speed equal to or higher than a prescribed rotation speed while the sheet conveying motor 5 is decelerating, the current rotation speed is calculated by using the sum of two adjacent cycles of the four control signals S7 to S10, and when the sheet conveying motor 5 rotates at a speed lower than the prescribed rotation speed while the sheet conveying motor 5 is decelerating, the current rotation speed is calculated by using the periods of the four control signals S7 to S10. In addition, when the sheet conveying motor 5 rotates at a speed higher than a prescribed rotation while the sheet conveying motor 5 is decelerating, the current rotation speed may be calculated by using the sum of two adjacent cycles of the four control signals S7 to S10, and when the sheet conveying motor 5 rotates at a speed equal to or lower than a prescribed rotation speed while the sheet conveying motor 5 is decelerating, the current rotation speed may be calculated by using the periods of the four control signals S7 to S10.

Next, a method of calculating the current rotation speed in a case where the sheet conveying motor 5 is controlled by the BS control will be described. In this case, as shown in FIGS. 14A to 14D, the current rotation speed is calculated by using a cycle T31 between a rising edge E(A1) of the first control signal S7 and a rising edge E(C1) of the third control signal S9, a cycle T32 between the rising edge E(C1) of the third control signal S9 and a rising edge E(B1) of the second control signal S8, a cycle T33 between the rising edge E(B1) of the second control signal S8 and a rising edge E(D1) of the fourth control signal S10, a cycle T34 between the rising edge E(D1) of the fourth control signal S10 and a falling edge E(A2) of the first control signal S7, a cycle T35 between the falling edge E(A2) of the first control signal S7 and a falling edge E(C2) of the third control signal S9, a cycle T36 between the falling edge E(C2) of the third control signal S9 and a falling edge E(B2) of the second control signal S8, a cycle T37 between the falling edge E(B2) of the second control signal S8 and a falling edge E(D2) of the fourth control signal S10, and a cycle T38 between the falling edge E(D2) of the fourth control signal S10 and the rising edge E(A1) of the first control signal S7. That is, in the order of the time periods T31, T32, T33, T34, T35, T36, T37, T38, T31, . . . , the current rotation speed is sequentially calculated on the basis of a cycle of the distances so that the speed calculator 54 sequentially outputs the current rotation speed signal Vc corresponding to the calculated current rotation speed. In addition, each of the time periods T31 to T38 corresponds to 1/16 of the cycle T1 of each of the detection signals S1 to S4.

The four first to fourth control signals S7 to S10 output from the rotary encoder 36 are input to the position calculator 55. The position calculator 55 calculates the current rotary position of the sheet conveying motor 5 on the basis of the four control signals S7 to S10 and outputs a current rotary position signal (that is, current position signal of the printing sheet P) Pc corresponding to the current rotary position. For example, the position calculator 55 calculates the current rotary position by sequentially counting the number of edges E(A1) to E(D2) of the four control signals S7 to S10.

Alternatively, the position calculator 55 may calculate the current rotary position by counting the edges E(A1) and E(A2) of the first control signal S7 and the edges E(B1) and E(B2) of the second control signal S8. Alternatively, the position calculator 55 may calculate the current rotary position by counting the edges E(C1) and E(C2) of the third control signal S9 and the edges E(D1) and E(D2) of the fourth control signal S10. Moreover, it is possible to change a method of calculating the current rotary position according to the rotation speed of the sheet conveying motor 5. For example, in a case where the sheet conveying motor 5 rotates at a speed equal to or higher than a prescribed rotation speed while the sheet conveying motor 5 is accelerating, is rotating at a constant speed, and is decelerating (for example, in FIG. 13, a case in which the rotation speed is equal to or higher than the speed V11 or the speed V21), the current rotation speed may be calculated by counting the edges E(A1) and E(A2) of the first control signal S7 and the edges E(B1) and E(B2) of the second control signal S8. In addition, in a case where the sheet conveying motor 5 rotates at a speed lower than the prescribed rotation speed while the sheet conveying motor 5 is decelerating, the current rotation speed may be calculated by counting the number of edges E(A1) to E(D2) of the four control signals S7 to S10.

The PID controller 56 is input with the current rotation speed signal Vc and the current rotary position signal Pc. The PID controller 56 performs a prescribed operation on the basis of the current rotation speed signal Vc and the current rotary position signal Pc and outputs a PID control signal to the sheet conveying motor driving circuit 48. Specifically, the PID controller 56 generates the following signals and outputs a PID control signal.

First, the PID controller 56 generates a position error signal corresponding to a difference between the current rotary position signal Pc and a target stopping position signal corresponding to a next stopping position of the printing sheet P. Further, the PID controller 56 generates a target rotation speed signal corresponding to the target rotation speed of the sheet conveying motor 5 on the basis of the position error signal and generates a speed error signal corresponding to a difference between the target rotation speed signal and the current rotation speed signal Vc. Moreover, the PID controller 56 generates a proportional control signal, an integral control signal, and a differential control signal on the basis of prescribed calculating expression based on the speed error signal. Thereafter, the PID controller 56 generates a PID control signal from the proportional control signal, the integral control signal, and the differential control signal and outputs the PID control signal to the sheet conveying motor driving circuit 48.

The current rotation speed signal Vc and the current rotation position signal Pc are input to the BS controller 57. The BS controller 57 performs a prescribed operation on the basis of the current rotation speed signal Vc and the current rotary position signal Pc and outputs the BS control signal to the sheet conveying motor driving circuit 48. Specifically, the BS controller 57 outputs the BS control signal as follows.

As mentioned above, the minute rotation speed that is used by the BS control and corresponds to an amount of minute rotation of the sheet conveying motor 5 is stored in the ROM 43. Besides, as shown in FIG. 12, the BS controller 57 includes a timer 58. Furthermore, in the case of the BS control, the BS controller 57 reads out the minute rotation speed from the ROM 43 and the timer 58 operates with a period corresponding to the minute rotation speed.

After the sheet conveying motor 5 starts operating, in a case where information on the current rotation speed calculated from the time periods T31 to T38 is not input from the speed calculator 54 within an operation cycle of the timer 58 (that is, in a case where the current rotation speed calculated from the time periods T31 to T38 is slower than the minute rotation speed and the current rotation speed of the sheet conveying motor 5 is not calculated in the speed calculator 54), the BS controller 57 outputs, as the BS control signal, a command of increasing the rotation speed to the sheet conveying motor driving circuit 48 such that the rotation speed of the sheet conveying motor 5 increases. In addition, in a case where the information on the current rotation speed calculated from the time periods T31 to T38 is not updated in a cycle shorter than the operation cycle of the timer 58 (that is, in a case where the current rotation speed calculated from the time periods T31 to T38 is faster than the minute rotation speed), the BS controller 57 outputs, as the BS control signal, a command of decreasing the rotation speed to the sheet conveying motor driving circuit 48 such that the rotation speed of the sheet conveying motor 5 decreases. In addition, in a case where the information on the current rotation speed calculated from the time periods T31 to T38 is updated in a period approximately equal to the operation cycle of the timer 58 (that is, in a case where the current rotation speed calculated from the time periods T31 to T38 is approximately equal to the minute rotation speed), the BS controller 57 outputs, as the BS control signal, a command of causing the rotation speed to be maintained to the sheet conveying motor driving circuit 48 such that the rotation speed of the sheet conveying motor 5 is maintained.

In the printer 1 having the configuration described above, the printing sheet P loaded from the hopper 11 to the inside of the printer 1 due to the sheet feeding roller 12 and the separating pad 13 is conveyed in the secondary scanning direction Y by the sheet conveying roller 6 that is driven to rotate by the sheet conveying motor 5, while the carriage 3 driven by the carriage motor 4 reciprocates in the primary scanning direction X. When the carriage 3 reciprocates, ink droplets are discharged from the printing head 2, such that printing onto the printing sheet P is performed. Moreover, after the printing onto the printing sheet P is completed, the printing sheet P is ejected to the outside of the printer 1 by the sheet ejecting roller 15 or the like.

When the printing sheet P is conveyed in the secondary scanning direction Y, the sheet conveying motor 5 drives the sheet conveying roller 6 to rotate. When the sheet conveying roller 6 rotates, the rotary scale 34 rotates together with the sheet conveying roller 6. When the rotary scale 34 rotates, the four control signals S7 to S10 are output from the rotary encoder 36. The output control signals S7 to S10 are input to the speed calculator 54 or position calculator 55 of the controller 37, for example. Further, in the controller 37, the current rotary position, the current rotation speed, and the like of the sheet conveying motor 5 are detected by using the control signals S7 to S10 output from the rotary encoder 36, such that prescribed control of the printer 1 is performed. For example, the PID control or BS control of the sheet conveying motor 5 is performed.

Furthermore, as described above, in a case where the sheet conveying motor 5 is controlled by the PID control, the speed calculator 54 calculates the current rotation speed on the basis of the cycles T(AH) to T(DL), each of which is the sum of two adjacent cycles of each of the four control signals S7 to S10, in correspondence with the rotation speed of the sheet conveying motor 5, or calculates the current rotation speed on the basis of the cycles T2(AH1) to T2(DL2) of the four control signals S7 to S10. Furthermore, in a case where the sheet conveying motor 5 is controlled by the BS control, the speed calculator 54 calculates the current rotation speed on the basis of the time periods T31 to T38 between edges of the four control signals S7 to S10.

As described above, in the first output signal generating circuit 70 in the present embodiment, the detection signals S1 to S4 output from the plurality of light receiving elements 69 are input to a first signal generator configured to include the first differential signal generating circuit 78, the second differential signal generating circuit 79, and the exclusive-OR circuit 80. In the first signal generator, the first control signal S7 that changes with the cycle T2 corresponding to a half of the cycle T1 of each of the detection signals S1 to S4 is generated. Similarly, in the second output signal generating circuit 71, the detection signals output from the plurality of light receiving elements 69 are input to a second signal generator and in the first signal generator, the second control signal S8 that changes with the cycle T2 corresponding to a half of the cycle T1 of each detection signal is generated. Similarly, in the third output signal generating circuit 72, the detection signals output from the plurality of light receiving elements 69 are input to a third signal generator and in the third signal generator, the third control signal S9 that changes with the cycle T2 corresponding to a half of the cycle T1 of each detection signal is generated. Similarly, in the fourth output signal generating circuit 73, the detection signals output from the plurality of light receiving elements 69 are input to a fourth signal generator and in the fourth signal generator, the fourth control signal S10 that changes with the cycle T2 corresponding to a half of the cycle T1 of each detection signal is generated. That is, in the present embodiment, the control signals S7 to S10 having resolution higher than the detection signals S1 to S4 are generated by the first to fourth signal generators, respectively. Therefore, in the present embodiment, high-resolution control of the printer 1 becomes possible with the simple configuration.

Moreover, in the present embodiment, in a case where the sheet conveying motor 5 is controlled by the PID control and the sheet conveying motor 5 rotates at a speed equal to or higher than the prescribed rotation speed while the sheet conveying motor 5 is accelerating, is rotating at a constant speed, and is decelerating, the speed calculator 54 calculates the current rotation speed of the sheet conveying motor 5 by using the cycles T(AH) to T(DL), each of which is the sum of two adjacent cycles of each of the four control signals S7 to S10. Therefore, it is possible to calculate a rotation speed that is appropriate as the current rotation speed of the sheet conveying motor 5. Effects acquired when using the configuration will be described below.

Figure 15A:
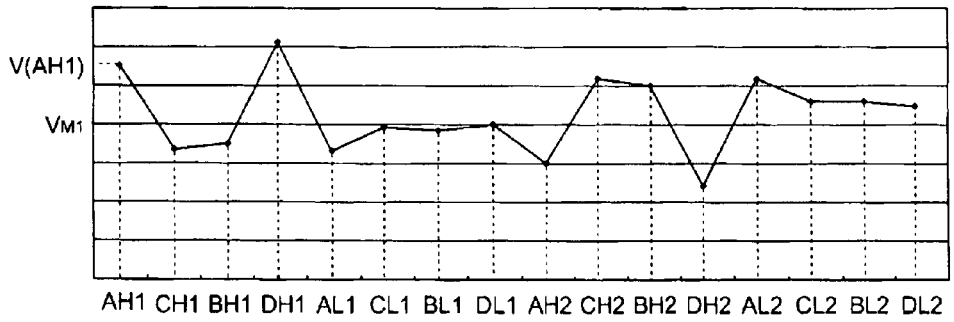
FIGS. 15A and 15B are graphs showing examples of rotation speed variations of the sheet conveying motor of FIG. 1, which are calculated by a speed calculator.
Figure 15B:
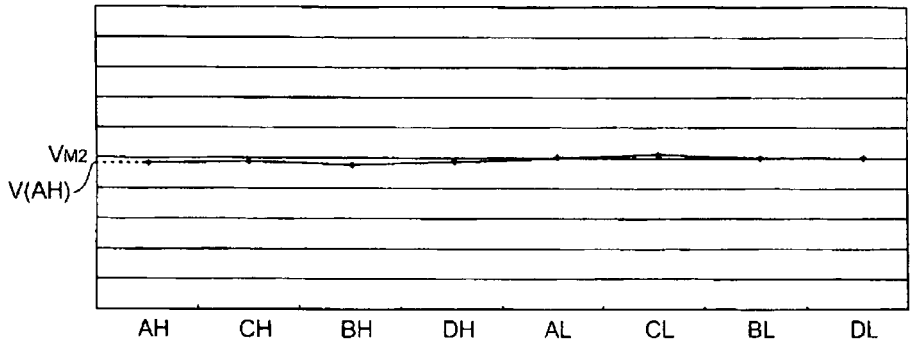

FIG. 15A illustrates an example of change of the rotation speed of the sheet conveying motor 5, which is calculated on the basis of the cycles T2(AH1) to T2(DL2) of the control signals S7 to S10 in the speed calculator 54, when the sheet conveying motor 5 rotates at an approximately constant speed. FIG. 15B illustrates an example of change of the rotation speed of the sheet conveying motor 5 calculated from the cycles T(AH) to T(DL), each of which is the sum of two adjacent cycles of each of the control signals S7 to S10. In the drawings, vertical axes illustrate the current rotation speed of the sheet conveying motor 5, and legends AH1 to DL2 indicated on a horizontal axis of FIG. 15A correspond to cycles T2(AH1) to T2(DL2), respectively. For example, the current rotation speed V(AH1) in a case where the horizontal axis is AH1 is a current rotation speed of the sheet conveying motor 5 calculated from the cycle T2(AH1). Similarly, legends AH to DL indicated on a horizontal axis of FIG. 15B correspond to cycles T(AH) to T(DL), respectively. For example, the current rotation speed V(AH) in a case where the horizontal axis is AH is a current rotation speed of the sheet conveying motor 5 calculated from the cycle T(AH).

In the printer 1 according to the present embodiment, when the sheet conveying motor 5 rotated at the approximately constant speed, the change of the rotation speed of the sheet conveying motor 5 calculated in the speed calculator 54 was checked. First, the change of the rotation speed of the sheet conveying motor 5 was checked by calculating the current rotation speed of the sheet conveying motor 5 on the basis of the cycles T2(AH1) to T2(DL2) of the control signals S7 to S10. In this case, as shown in FIG. 15A, in spite of having caused the sheet conveying motor 5 to rotate at the approximately constant speed, a calculation result in the case of calculating the current rotation speed of the sheet conveying motor 5 on the basis of the cycles T2(AH1) to T2(DL2) varied. That is, even though the actual rotation speed of the sheet conveying motor 5 did not almost change, the cycles T2(AH1) to T2(DL2) are varied and it could be seen that the calculated current rotation speed of the sheet conveying motor 5 fluctuated largely. Fluctuation of the current rotation speed was about ±3 to 4% of a central rotation speed $V_{M1}$ of the sheet conveying motor 5, for example. In addition, it is guessed that the fluctuation of the current rotation speed occurs due to a difference among sensitivities of the plurality of light receiving elements 69, which are arranged on the substrate 68 of the rotary scale 34, or fluctuation in arrangement of the light receiving elements 69.

Further, a result of having checked the rotation speed of the sheet conveying motor 5 by calculating the current rotation speed of the sheet conveying motor 5 on the basis of the cycles T(AH) to T(DL), each of which is the sum of two adjacent cycles of each of the control signals S7 to S10, is as follows. That is, as shown in FIG. 15B, in the case of calculating the current rotation speed of the sheet conveying motor 5 on the basis of the cycles T(AH) to T(DL), the cycles T(AH) to T(DL) did not vary if the sheet conveying motor 5 rotates at the approximately constant speed. As a result, it could be seen that the calculated current rotation speed of the sheet conveying motor 5 did not almost fluctuate. For example, fluctuation of the current rotation speed was about ±0.02% or less of a central rotation speed $V_{M2}$ of the sheet conveying motor 5.

Thus, in the present embodiment, in a case where the sheet conveying motor 5 is controlled by the PID control and the sheet conveying motor 5 rotates at a speed equal to or higher than the prescribed rotation speed while the sheet conveying motor 5 is accelerating, is rotating at a constant speed, and is decelerating, the speed calculator 54 calculates the current rotation speed of the sheet conveying motor 5 by using the cycles T(AH) to T(DL), each of which is the sum of two adjacent cycles of each of the control signals S7 to S10. Particularly in the case of the sheet conveying motor 5, in order to perform an appropriate rotation speed control in a region where the sheet conveying motor 5 rotates at a relatively high speed, information on the appropriate rotation speed of the sheet conveying motor 5 is required. Therefore, by using the configuration described above, it is possible to obtain the information on the appropriate rotation speed in the region where the sheet conveying motor 5 rotates at the relatively high speed. Moreover, in this case, even though information on the calculated current rotation speed of the sheet conveying motor 5 (that is, the sampling number of the current rotation speed of the sheet conveying motor 5) decreases as compared with a case where the rotation speed of the sheet conveying motor 5 is calculated by using the periods of the control signals S7 to S10, each of the control signals S7 to S10 changes with the cycle T2 corresponding to a half of the cycle T1 of each of the detection signals S1 to S4. Accordingly, a number of edges E(A1) to E(D2) of the control signals S7 to S10 are input to the position calculator 55 in a short period. As a result, information on the rotary position of the sheet conveying motor 5 that is calculated in the position calculator 55 increases as compared with the related art. Therefore, in the printer 1 according to the present embodiment, it becomes possible to calculate the appropriate rotation speed of the sheet conveying motor 5 and to perform the high-resolution control.

Particularly in the present embodiment, the plurality of light receiving elements A1 to A4 located in the A-row, which serve as the first detection elements, and the plurality of light receiving elements B1 to B4 located in the B-row, which serve as the second detection elements, are disposed to be shifted from each other by ⅛ of the arrangement pitch K between the marks 65. In addition, the plurality of light receiving elements C1 to C4 located in the C-row, which serve as the third detection elements, are disposed to be shifted by 1/16 of the arrangement pitch K of the marks 65 with respect to the plurality of light receiving elements A1 to A4 located in the A-row. In addition, the plurality of light receiving elements D1 to D4 located in the D-row, which serve as the fourth detection elements, are disposed to be shifted by ⅛ of the arrangement pitch K of the marks 65 with respect to the plurality of light receiving elements C1 to C4 located in the C-row. In addition, each of the cycles T2 of the control signals S7 to S10 generated by the first to fourth signal generators is a period corresponding to a half of the cycle T1 of each of the detection signals S1 to S4.

For this reason, phases of the first control signal S7 and the third control signal S9, phases of the third control signal S9 and the second control signal S8, phases of the second control signal S8 and the fourth control signal S10, and phases of the fourth control signal S10 and the first control signal S7 are shifted from each other by 45° with the cycle T2 of the control signals S7 to S10, respectively. Accordingly, since the speed calculator 54 can calculate the current rotation speed of the sheet conveying motor 5 by using the cycles T(AH) to T(DL), each of which is the sum of two adjacent cycles of each of the four control signals S7 to S10, a larger amount of information on the rotation speed of the sheet conveying motor 5 than the related art can be acquired. That is, even if the current rotation speed of the sheet conveying motor 5 is calculated by using the sum of two adjacent cycles of each of the control signals S7 to S10, it is possible to acquire the larger amount of information on the rotation speed of the sheet conveying motor 5 than the related art. In addition, even if the rotation speed of the sheet conveying motor 5 increases, the edges E(A1) to E(D2) of the control signals S7 to S10 do not overlap easily because the phases of the four control signals S7 to S10 are shifted from each other by 45°. As a result, the position calculator 55 can appropriately calculate the rotary position of the sheet conveying motor 5.

In the present embodiment, in a case where the sheet conveying motor 5 is controlled by the PID control and the sheet conveying motor 5 rotates at a speed lower than the prescribed rotation speed while the sheet conveying motor 5 is decelerating, the speed calculator 54 calculates the current rotation speed of the sheet conveying motor 5 by using the cycles T2(AH1) to T2(DL2) of the four control signals S7 to S10. In the case of the sheet conveying motor 5, in order to improve the accuracy of stopping position of the sheet conveying motor 5 (that is, in order to improve the stopping accuracy of the printing sheet P) in a region 20 where the sheet conveying motor 5 rotates at a low speed, a large amount of information on the current rotation speed is required. Therefore, by using the configuration described above, it is possible to obtain a large amount of information on the rotation speed on the basis of the control signals S7 to S10, each of which changes with the cycle T2 corresponding to a half of the cycle T1 of each of the detection signals S1 to S4, in the region where the sheet conveying motor 5 rotates at the low speed. As a result, the rotation speed of the sheet conveying motor 5 can be controlled on the basis of the large amount of information on the rotation speed. In this way, the accuracy of stopping position of the sheet conveying motor 5 can be improved.

In the present embodiment, in the case that the sheet conveying motor 5 is controlled by the BS control (that is, in a case where the sheet conveying motor 5 rotates at the very low speed by the minute amount), the speed calculator 54 calculates the current rotation speed of the sheet conveying motor 5 by using the time periods T31 to T38 of the four control signals S7 to S10. Since each of the time periods T31 to T38 is a distance corresponding to 1/16 of the cycle T1 of each detection signal, a larger amount of information on the rotation speed of the sheet conveying motor 5 can be acquired by using the time periods T31 to T38 when the printing sheet P or an object to be printed is conveyed at the extremely low speed. Accordingly, the rotation speed of the sheet conveying motor 5 can be controlled on the basis of the larger amount of information on rotation speed. In addition, the minute position control on the sheet conveying motor 5 can also be made on the basis of the larger amount of information on rotation speed. As a result, for example, the position of a trailing end of the printing sheet P can be determined with high precision.

Although the preferred embodiment of the invention has been described above, the invention is not limited to the above embodiment. That is, various modifications and changes can be made without departing from the subject matter of the invention.

In the embodiment described above, in a case where the sheet conveying motor 5 is controlled by the PID control and the sheet conveying motor 5 rotates at the speed equal to or higher than a prescribed rotation speed while the sheet conveying motor 5 is accelerating, is rotating at a constant speed, and is decelerating, the current rotation speed of the sheet conveying motor 5 is calculated by using the cycles T(AH) to T(DL), each of which is the sum of two adjacent cycles of each of the four control signals S7 to S10. However, for example, the current rotation speed of the sheet conveying motor 5 may be calculated from an average period of two adjacent cycles of each of the four control signals S7 to S10. Even in this case, it is possible to acquire the effects according to the above-described embodiment that a rotation speed appropriate as the current rotation speed of the sheet conveying motor 5 can be calculated.

Further, in the embodiment described above, the four control signals S7 to S10 are output from the rotary encoder 36. However, for example, the detector 35 may be configured such that only two control signals S7 and S8 are output from the rotary encoder 36. In addition, for example, the detector 35 may be configured to include only two output signal generating circuits of the first output signal generating circuit 70 and the second output signal generating circuit 71. Even in this case, since a phase difference between the first control signal S7 and the second control signal S8 is 90° (45° in the cycle T1 of the detection signals S1 to S4) in the cycle T2 of the control signals S7 and S8, it is possible to acquire a larger amount of information on the rotation speed of the sheet conveying motor 5 than the related art by using the cycles T(AH) to T(BL), each of which is the sum of two adjacent cycles of each of the two control signals S7 and S8. As a result, new information on the rotation speed can be acquired, which makes possible the control of a printer based on the rotation speed information. Moreover, even in the case having the configuration described above, if the sheet conveying motor 5 is controlled by the BS control, a large amount of information on the current rotation speed can be obtained from a distance between the edges E(A1) and E(A2) of the first control signal S7 and the edges E(B1) and E(B2) of the second control signal S8. As a result, the position of the printing sheet P can be determined with high precision. Further, in this case, the phase difference between the first control signal S7 and the second control signal S8 is 90° in the cycle T2 of the control signals S7 and S8. Accordingly, even if the rotation speed of the sheet conveying motor 5 increases, the edges E(A1) and E(A2) of the first control signal S7 and the edges E(B1) and E(B2) of the second control signal S8 do not overlap easily. As a result, the rotary position of the sheet conveying motor 5 can be appropriately calculated in the position calculator 55.

Further, in the embodiment described above, the control signals S7 to S10, each of which has the cycle T2 corresponding to a half of the cycle T1 of each of the detection signals S1 to S4, are output from the rotary encoder 36. Alternatively, for example, a control signal having a cycle T3 corresponding to a quarter of the cycle T1 of each of the detection signals S1 to S4 may be output from the rotary encoder 36.

Figure 16:
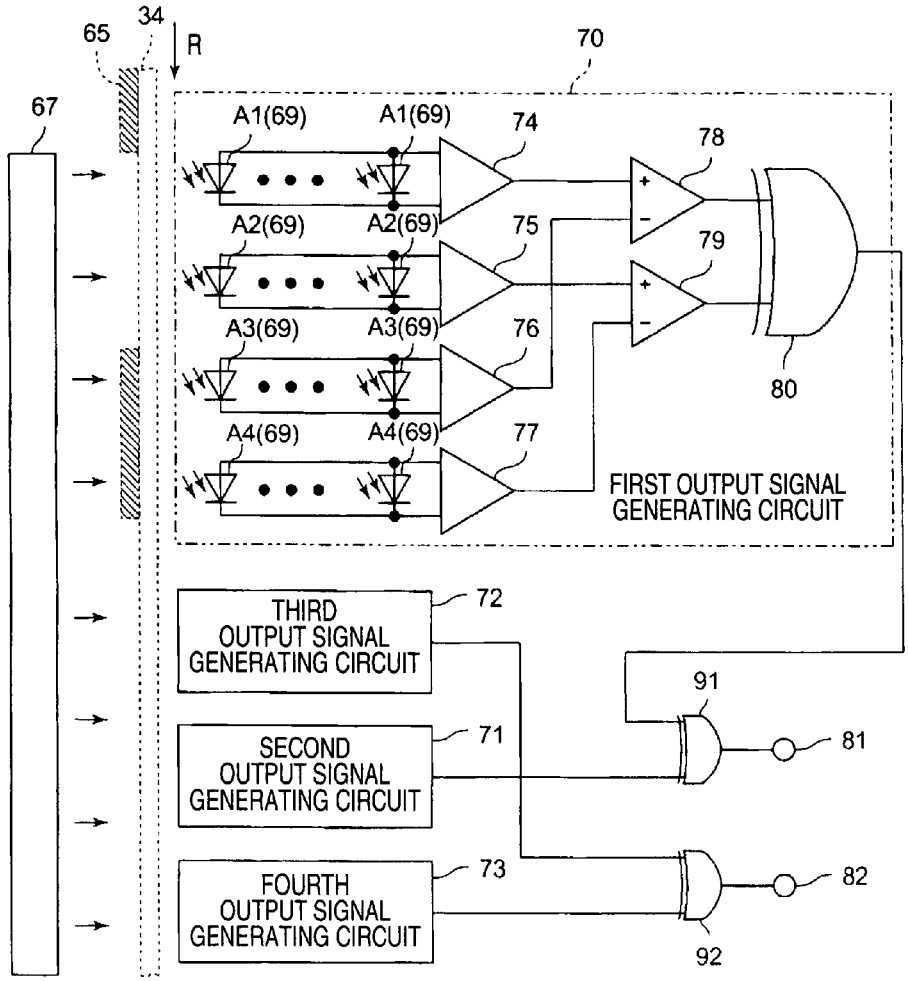
FIG. 16 is a circuit diagram of a rotary encoder in a printer according to a modified example.
Figures 17A, 17B, 17C, 17D, 17E, 17F, 17G, 17H, 17I, 17J:
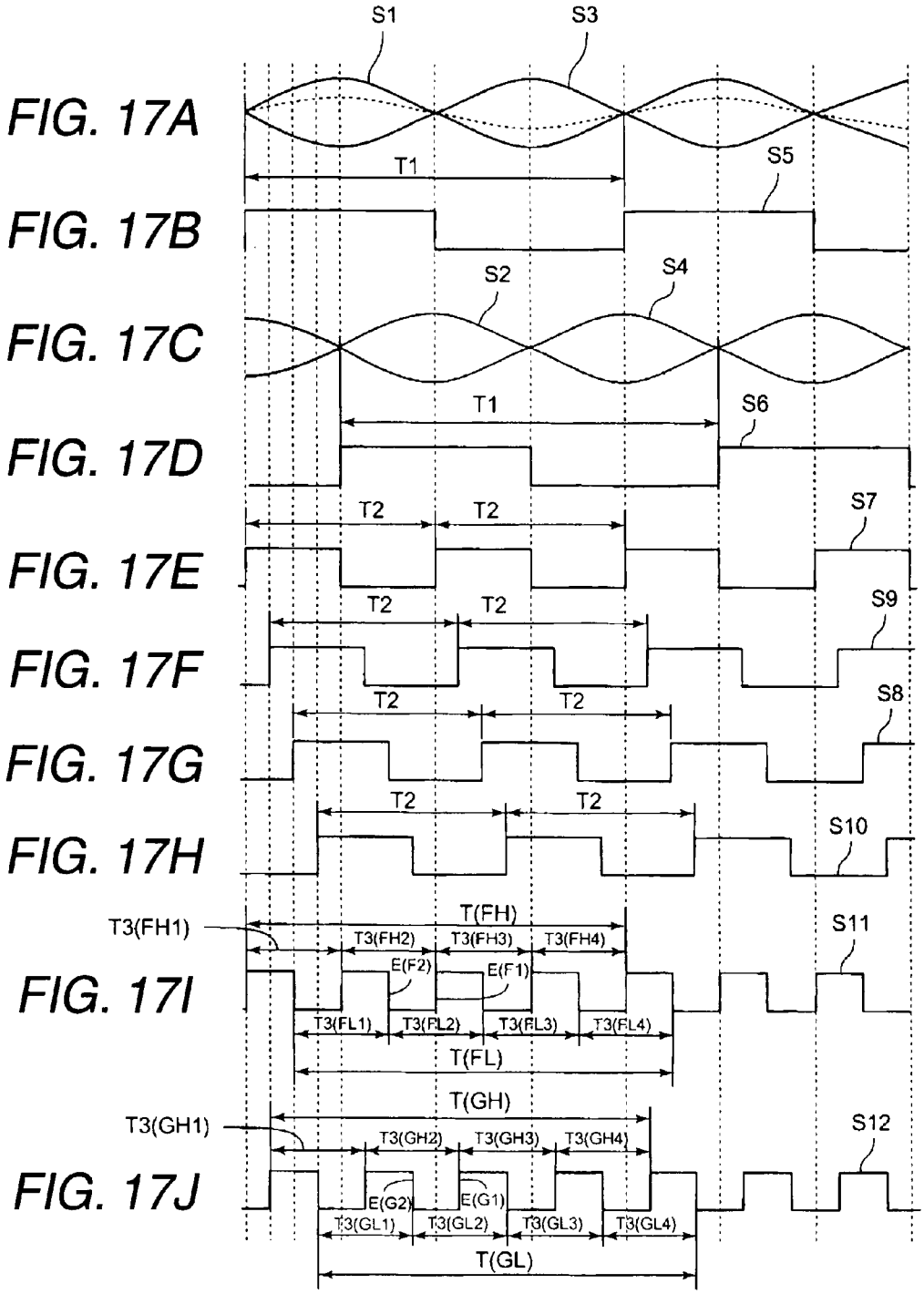
FIGS. 17A to 17J are waveform charts showing signals generated in the rotary encoder of FIG. 16.

FIG. 16 illustrates an electrical circuit of a rotary encoder in such a configuration. FIG. 17A illustrates waveforms of detection signals S1 and S3 output from the first amplifier 74 and the third amplifier 76 shown in FIG. 16. FIG. 17B illustrates a waveform of an output signal S5 of the first differential signal generating circuit 78 shown in FIG. 16. FIG. 17C illustrates waveforms of detection signals S2 and S4 output from the second amplifier 75 and the fourth amplifier 77 shown in FIG. 16. FIG. 17D illustrates a waveform of an output signal S6 of the second differential signal generating circuit 79 shown in FIG. 16. FIG. 17E illustrates a waveform of a first control signal S7 output from the exclusive-OR circuit 80 shown in FIG. 16. FIG. 17F illustrates a waveform of a third control signal S9 output from the third output signal generating circuit 72 shown in FIG. 16. FIG. 17G illustrates a waveform of a second control signal S8 output from the second output signal generating circuit 71 shown in FIG. 16. FIG. 17H illustrates a waveform of a fourth control signal S10 output from the fourth output signal generating circuit 73 shown in FIG. 16. FIG. 17I illustrates a waveform of a fifth control signal S11 output from a first output exclusive-OR circuit 91 shown in FIG. 16. FIG. 17J illustrates a waveform of a sixth control signal S12 output from a second output exclusive-OR circuit 92 shown in FIG. 16. In addition, in FIGS. 17A to 17J, the constituent components that are common with the above-described embodiment have the same reference numbers.

In an example shown in FIG. 16, the first output exclusive-OR circuit 91 and the second output exclusive-OR circuit 92 are provided in addition to the first output signal generating circuit 70, the second output signal generating circuit 71, the third output signal generating circuit 72, and the fourth output signal generating circuit 73 that have been explained above.

The first control signal S7 output from the first output signal generating circuit 70 and the second control signal S8 output from the second output signal generating circuit 71 are input to the first output exclusive-OR circuit 91. The first output exclusive-OR circuit 91 generates, as the fifth control signal S11, a signal corresponding to exclusive-OR between the first control signal S7 and the second control signal S8 and then outputs the generated signal. That is, as shown in FIG. 17I, the first output exclusive-OR circuit 91 generates the fifth control signal S11 having the cycle T3 corresponding to a half of a cycle T2 of each of the first and second control signals S7 and S8 (that is, a quarter of a cycle T1 of each of the detection signals S1 to S4) and then outputs the fifth control signal S11 from an output terminal 81.

Furthermore, the third control signal S9 output from the third output signal generating circuit 72 and the fourth control signal S10 output from the fourth output signal generating circuit 73 are input to the second output exclusive-OR circuit 92. The second output exclusive-OR circuit 92 generates, as the sixth control signal S12, a signal corresponding to exclusive-OR between the third control signal S9 and the fourth control signal S10 and then outputs the generated signal. That is, as shown in FIG. 17J, the second output exclusive-OR circuit 92 generates the sixth control signal S12 having the cycle T3 corresponding to a half of the cycle T2 of each of the third and fourth control signals S9 and S10 (that is, a quarter of the cycle T1 of each of the detection signals S1 to S4) and then outputs the sixth control signal S12 from an output terminal 82.

Thus, in the configuration in which a control signal having the cycle T3 corresponding to a quarter of the cycle T1 of each of the detection signals S1 to S4 is output from the rotary encoder 36, in a case where the sheet conveying motor 5 is controlled by the PID control and the sheet conveying motor 5 rotates at the speed equal to or higher than the prescribed rotation speed while the sheet conveying motor 5 is accelerating, is rotating at a constant speed, and is decelerating, the speed calculator 54 calculates the current rotation speed of the sheet conveying motor 5 by using a sum of four adjacent cycles of each of the two control signals S11 and S12.

Specifically, as shown in FIGS. 17I and 17J, the speed calculator 54 calculates the current rotation speed on the basis of a cycle T(FH) that is a sum of a cycle T3(FH1), a cycle T3(FH2), a cycle T3(FH3), and a cycle T3(FH4), a cycle T(FL) that is a sum of a cycle T3(FL1), a cycle T3(FL2), a cycle T3(FL3), and a cycle T3(FL4), a cycle T(GH) that is a sum of a cycle T3(GH1), a cycle T3(GH2), a cycle T3(GH3), and a cycle T3(GH4), or a cycle T(GL) that is a sum of a cycle T3(GL1), a cycle T3(GL2), a cycle T3(GL3), and a cycle T3(GL4). That is, in the order of the cycles T(FH), T(GH), T(FL), T(GL), T(FH), . . . , the current rotation speed is sequentially calculated on the basis of the periods and the speed calculator 54 sequentially outputs the current rotation speed signal Vc corresponding to the calculated current rotation speed.

Moreover, in the case that the sheet conveying motor 5 is controlled by the PID control, when the sheet conveying motor 5 rotates at a speed lower than the prescribed rotation speed while the sheet conveying motor 5 is decelerating, the speed calculator 54 calculates the current rotation speed on the basis of periods of the two control signals S11 to S12.

Specifically, as shown in FIGS. 17I and 17J, in the order of T3(FH1), T3(GH1), T3(FL1), T3(GL1), T3(FH2), T3(GH2), T3(FL2), T3(GL2), T3(FH3), T3(GH3), T3(FL3), T3(GL3), T3(FH4), T3(GH4), T3(FL4), T3(GL4), T3(FH1), . . . , the current rotation speed is sequentially calculated on the basis of the periods and the speed calculator 54 sequentially outputs the current rotation speed signal Vc corresponding to the calculated current rotation speed.

Further, in a case where the sheet conveying motor 5 is controlled by the BS control, the current rotation speed of the sheet conveying motor 5 is calculated by using a distance between a rising edge E(F1) of the fifth control signal S11 and a rising edge E(G1) of the sixth control signal S12, a distance between the rising edge E(G1) of the sixth control signal S12 and a falling edge E(F2) of the fifth control signal S11, a distance between the falling edge E(F2) of the fifth control signal S10 and a falling edge E(G2) of the sixth control signal S12, and a distance between the falling edge E(G2) of the sixth control signal S12 and a rising edge E(F1) of the fifth control signal S11. In addition, the speed calculator 54 sequentially outputs the current rotation speed signal Vc corresponding to the calculated current rotation speed.

Furthermore, while printing onto a printing sheet is being performed, the printing sheet is conveyed by the BS control of the CPU at prescribed timing based on a total conveyed amount of the printing sheet from a leading end of the printing sheet. In a case where the sheet conveying motor is controlled by the BS control while printing is being performed, the rotation speed of the sheet conveying motor may be calculated on the basis of periods of the two control signals S11 and S12.

Furthermore, in the example shown in FIG. 16, even though the two control signals S11 and S12 are output from the rotary encoder 36, four control signals that change with the cycle T3 corresponding to a quarter of the cycle T1 of each of the detection signals S1 to S4 may be output from the rotary encoder 36. In addition, a signal corresponding to exclusive-OR between the fifth control signal S11 and the sixth control signal S12 may be further generated as a control signal and a control signal that changes with a period corresponding to ⅛ of the cycle T1 of each of the detection signals S1 to S4 may be output from the rotary encoder 36. Similarly, a control signal that changes with a period corresponding to 1/16 of the cycle T1 of each of the detection signals S1 to S4 may be output from the rotary encoder 36. That is, the rotary encoder 36 may be configured to output a control signal that changes with a period corresponding to $1/2^{n1}$ ("n1" is an integer equal to or larger than 1) of the cycle T1 of each of the detection signals S1 to S4. In this case, it is preferable that the current rotation speed be calculated from a sum of adjacent $2^{n1}$ periods of the control signal.

In the embodiment described above, the control signals S7 to S10 are generated in the detector 35 of the rotary encoder 36. In addition, for example, the detection signals S1 to S4 may be output from the detector 35, and the control signals S7 to S10 may be generated in the controller 37. Alternatively, the digital signals S5 and S6 and the like may be output from the detector 35, and the control signals S7 to S10 may be generated in the controller 37.

In the embodiment described above, in the case that the sheet conveying motor 5 is controlled by the PID control, when the sheet conveying motor 5 rotates at the speed lower than a prescribed rotation speed while the sheet conveying motor 5 is decelerating, the current rotation speed is calculated on the basis of periods of the four control signals S7 to S10. In addition, for example, in the case that the sheet conveying motor 5 is controlled by the PID control, the current rotation speed may be calculated on the basis of a sum of two adjacent cycles of each of the four control signals S7 to S10 until the sheet conveying motor 5 stops after the sheet conveying motor 5 starts operating. For example, if the stopping accuracy of the printing sheet P is not required according to a conveying mode of the printing sheet P or the like, such configuration is preferable. In this case, it is possible to make signal processing in the speed calculator 54 simple as compared with a case in which the rotation speed of the sheet conveying motor 5 is calculated on the basis of periods of the control signals S7 to S10.

In addition, since a maximum rotation speed of the sheet conveying motor is determined by a paper conveying mode set corresponding to a print mode, such as print resolution and type of a printing sheet, a control signal used to calculate the rotation speed of the sheet conveying motor may change depending on the print mode. For example, in a case where the maximum rotation speed of the sheet conveying motor determined by the print mode is equal to or higher than a prescribed value, the rotation speed of the sheet conveying motor may be calculated by using a sum of two adjacent cycles of each of the four control signals S7 to S10 or an average period of two adjacent cycles of each of the four control signals S7 to S10. Furthermore, in a case where the maximum rotation speed of the sheet conveying motor is lower than a prescribed speed, the rotation speed of the sheet conveying motor may be calculated on the basis of the periods of the two control signals S11 and S12

In the embodiment described above, the rotary encoder 36 is a light-transmissive rotary encoder in which the light receiving elements 69 receive light that has been transmitted through a transparent portion between the marks 65. Alternatively, for example, the rotary encoder 36 may be a light-reflective rotary encoder in which the light receiving elements 69 receive light reflected from a plurality of marks. In addition, without being limited to an optical-type rotary encoder, other types of rotary encoders such as a magnetic-type rotary encoder may be used. Moreover, the configuration of the invention may be applied to the linear encoder 33 that detects the rotation speed, the rotary position, or the like of the carriage motor 4.

Further, in the embodiment described above, the light receiving elements 69 located in the B-row are formed to be shifted by 1/8 of the arrangement pitch K to the right side of the light receiving elements 69 located in the A-row in FIG. 8. However, in order to achieve the above-mentioned effects, preferably, the light receiving elements 69 located in the B-row are disposed to be shifted by (n2+1/8) (n2 is an integer equal to or larger than 0) of the arrangement pitch K with respect to the light receiving elements 69 located in the A-row. Similarly, even though the light receiving elements 69 located in the C-row are formed to be shifted by 1/16 of the arrangement pitch K to the right side of the light receiving elements 69 located in the A-row in FIG. 8, the light receiving elements 69 located in the A-row may be disposed to be shifted by (n3+1/16) (n3 is an integer equal to or larger than 0) of the arrangement pitch K with respect to the light receiving elements 69 located in the A-row. In addition, the light receiving elements 69 located in the D-row may be disposed to be shifted by (n4+1/8) (n4 is an integer equal to or larger than 0) of the arrangement pitch K with respect to the light receiving elements 69 located in the C-row.

Furthermore, in the embodiment described above, while the sheet conveying motor 5 is decelerating in the case that the sheet conveying motor 5 is controlled by the PID control, it is selected according to the rotation speed of the sheet conveying motor 5 whether to calculate the current rotation speed of the sheet conveying motor 5 on the basis of a sum of two adjacent cycles of each of the four control signals S7 to S10 or to calculate the current rotation speed of the sheet conveying motor 5 on the basis of the cycle T2 of each of the four control signals S7 to S10. In addition, for example, while the sheet conveying motor 5 is decelerating in the case that the sheet conveying motor 5 is controlled by the PID control, it may be selected according to the rotary position of the sheet conveying motor 5 whether to calculate the current rotation speed of the sheet conveying motor 5 on the basis of a sum of two adjacent cycles of each of the four control signals S7 to S10 or to calculate the current rotation speed of the sheet conveying motor 5 on the basis of the cycle T2 of each of the four control signals S7 to S10.

For example, as shown in FIG. 13, when the rotary position of the sheet conveying motor 5 is within a range from a prescribed rotary position X11 before the sheet conveying motor 5 stops to the target stopping position X1 (that is, within a prescribed range from the target stopping position X1) or when the rotary position of the sheet conveying motor 5 is within a range from a prescribed rotary position X21 before the sheet conveying motor 5 stops to the target stopping position X2 (that is, within a prescribed range from the target stopping position X2), the current rotation speed of the sheet conveying motor 5 is calculated by using the cycle T2 of each of the four control signals S7 to S10. When the rotary position of the sheet conveying motor 5 exists outside the range, the current rotation speed of the sheet conveying motor 5 is calculated by using the sum of two adjacent cycles of each of the four control signals S7 to S10.

In the above embodiment, the configuration of the invention has been described by using the printer 1 as an example. However, the invention may also be applied to a multi-function printer, a scanner, an ADF (auto document feeder) apparatus, a copying machine, a facsimile apparatus, and the like.

Further, in the embodiment described above, a liquid ejecting apparatus has been embodied as a printer that performs printing on a printing sheet. However, the liquid ejecting apparatus may be embodied as a printer serving as a liquid ejecting apparatus that is used to manufacture a color filter for a liquid crystal display and the like, form pixels in an organic EL display and the like, and form a pattern of a semiconductor device.

Furthermore, in the embodiment described above, a serial printer that performs printing by causing the carriage to move in the primary scanning direction has been exemplified. However, a printer in which a printing head is disposed over the width of paper in the primary scanning direction may be used.

The disclosure of Japanese Patent Application No. 2006-17377 filed Jan. 26, 2006 including specification, drawings and claims is incorporated herein by reference in its entirety.

What is claimed is:

1. A printer, comprising:

a scale provided with a plurality of marks or slits arranged in a first direction such that a distance between centers of adjacent marks or slits in the first direction assumes a first length;

an encoder, opposing the scale and comprising:

a photo emitter, operable to emit light; and a plurality of photo detectors, each of which has a light receiving region adapted to receive the light emitted from the photo emitter and transmitted by way of the marks or slits, and is operable to output a detection signal in accordance with a quantity of the light received by the light receiving region, so that the detection signal has a first cycle corresponding to the first length;

a control signal generator, operable to generate a control signal having a second cycle which is ($1/2^{n1}$) of the first cycle;

a motor; and a controller, operable to estimate a rotation speed of the motor based on a third cycle which is defined by subsequent ($2^{n1}$) second cycles, wherein:

n1 is an integer no less than one, and the photo detectors are arranged in a second direction perpendicular to the first direction while being shifted in the first direction by a second length which is not an integral multiple of the first length.

2. The printer as set forth in claim 1, wherein:

the second length is (n2+1/8) times of the first length;

n1 is one; and n2 is an integer no less than zero.

3. The printer as set forth in claim 1, wherein:

the second length is (n2+1/16) times of the first length;

n1 ; and n2 is an integer no less than zero.

4. The printer as set forth in claim 1, wherein:

the motor is operable to transport a medium adapted to be subjected to printing.

5. The printer as set forth in claim 1, further comprising:

a carriage, operable to carry a printing head which is operable to eject ink toward a target medium, wherein:

the motor is operable to move the carriage.

6. The printer as set forth in claim 1, wherein:

the controller is operable to estimate a rotary position of the motor;

the controller is operable to estimate the rotation speed of the motor based on the third cycle at least one of when the estimated rotation speed is no less than a prescribed speed and when a difference between the estimated rotary position and a target position is no less than a prescribed value; and the controller is operable to estimate the rotation speed of the motor based on the second cycle at least one of when the estimated rotation speed is less than the prescribed speed and when a difference between the estimated rotary position and a target position is less than the prescribed value.

7. The printer as set forth in claim 1, wherein:

the controller is operable to estimate a rotary position of the motor;

the controller is operable to estimate the rotation speed of the motor based on the third cycle at least one of when the estimated rotation speed is greater than a prescribed speed and when a difference between the estimated rotary position and a target position is greater than a prescribed value; and the controller is operable to estimate the rotation speed of the motor based on the second cycle at least one of when the estimated rotation speed is no greater than the prescribed speed and when a difference between the estimated rotary position and a target position is no greater than the prescribed value.

8. The printer as set forth in claim 1, wherein:

the controller is operable to estimate the rotation speed of the motor based on a time interval corresponding to the second length when the estimated rotation speed is no greater than a prescribed speed.

9. A method executed in a printer which comprises:

a motor;

a scale provided with a plurality of marks or slits arranged in a first direction such that a distance between centers of adjacent marks or slits in the first direction assumes a first length; and an encoder, opposing the scale and comprising:

a photo emitter, operable to emit light; and a plurality of photo detectors, each of which has a light receiving region adapted to receive the light emitted from the photo emitter and transmitted by way of the marks or slits, and is operable to output a detection signal in accordance with a quantity of the light received by the light receiving region, so that the detection signal has a first cycle corresponding to the first length, the method comprising:

generating a control signal having a second cycle which is ($1/2^{n1}$) of the first cycle; and estimating a rotation speed of the motor based on a third cycle which is defined by subsequent ($2^{n1}$) second cycles, wherein:

n1 is an integer no less than one, and the photo detectors are arranged in a second direction perpendicular to the first direction while being shifted in the first direction by a second length which is not an integral multiple of the first length.

* * * * *